US008882941B2

(12) United States Patent
Branagan et al.

(10) Patent No.: US 8,882,941 B2
(45) Date of Patent: Nov. 11, 2014

(54) MECHANISM OF STRUCTURAL FORMATION FOR METALLIC GLASS BASED COMPOSITES WITH ENHANCED DUCTILITY

(75) Inventors: Daniel James Branagan, Idaho Falls, ID (US); Jeffrey E. Shield, Lincoln, NE (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 858 days.

(21) Appl. No.: 12/580,858

(22) Filed: Oct. 16, 2009

(65) Prior Publication Data

US 2010/0154942 A1 Jun. 24, 2010

Related U.S. Application Data

(60) Provisional application No. 61/107,037, filed on Oct. 21, 2008.

(51) Int. Cl.

| | |
|---|---|
| ***C21D 5/00*** | (2006.01) |
| ***C22C 45/02*** | (2006.01) |
| *C21D 1/84* | (2006.01) |
| *C22C 37/00* | (2006.01) |
| *C22C 37/10* | (2006.01) |
| *C22C 38/32* | (2006.01) |

(52) U.S. Cl.

CPC ..... *C22C 45/02* (2013.01)
USPC ..... 148/540; 148/321; 148/330; 148/543

(58) Field of Classification Search

CPC ..... C22C 45/00; C22C 45/02
USPC ..... 148/321, 330, 540, 543
See application file for complete search history.

(56) References Cited

U.S. PATENT DOCUMENTS

| | | | | |
|---|---|---|---|---|
| 4,515,870 | A * | 5/1985 | Bose et al. | 428/656 |
| 4,806,179 | A * | 2/1989 | Hagiwara et al. | 148/403 |
| 6,254,695 | B1 * | 7/2001 | Herzer et al. | 148/108 |
| 6,355,361 | B1 * | 3/2002 | Ueno et al. | 428/611 |
| 2005/0252586 | A1 | 11/2005 | Branagan | |
| 2006/0213586 | A1 | 9/2006 | Kui | |
| 2007/0079907 | A1 * | 4/2007 | Johnson et al. | 148/403 |
| 2007/0187010 | A1 | 8/2007 | Baker et al. | |
| 2008/0213517 | A1 | 9/2008 | Branagan | |

OTHER PUBLICATIONS

International Search Report and Written Opinion dated Dec. 10, 2009 issued in related International Patent Application No. PCT/US09/61059.

ASTM E 2456-06, Standard Terminology Relating to Nanotechnology, 2007.

(Continued)

*Primary Examiner* — Keith Walker
*Assistant Examiner* — Alexander Polyansky
(74) *Attorney, Agent, or Firm* — Grossman, Tucker, Perrault & Pfleger, PLLC

(57) ABSTRACT

An aspect of the present disclosure relates to an alloy composition, which may include 52 atomic percent to 68 atomic percent iron, 13 to 21 atomic percent nickel, 2 to 12 atomic percent cobalt, 10 to 19 atomic percent boron, optionally 1 to 5 atomic percent carbon, and optionally 0.3 to 16 atomic percent silicon. The alloy may include 5 to 95% by volume of one or more spinodal microconstituents, wherein the microconstituents exhibit a length scale less than 50 nm in a glass matrix.

15 Claims, 37 Drawing Sheets a)

b)

(56) References Cited

OTHER PUBLICATIONS

Gleiter, "Nanocrystalline Materials," Prog. Mater. Sci. 33 (1989), 223-315.
Dao, "Toward a quantitative understanding of mechanical behavior of nanocrystalline metals," Acta Materialia 55 (2007), 4041-4065.
Klement, "Non-crystalline Structure in Solidified Gold-Silicon Alloys," Nature 187 (1960), 869-870.
Johnson, "Bulk Glass-Forming Metallic Alloys: Science and Technology," MRS Bull. 24 (1999), 42-56.
Inoue, "Stabilization of Metallic Supercooled Liquid and Bulk Amorphous Alloys," Acta mater. 48 (2000) 279-306.
Greer, "Bulk Metallic Glasses: At the Cutting Edge of Metals Research," MRS Bulletin 32 (2007), 611.
Jia, "Effects of Nanocrystalline and Ultrafine Grain Sizes on Constitutive Behavior and Shear Bands in Iron," Acta Mater. 51 (2003), 3495-3509.
Flores, "Mean Stress Effects on Flow Localization and Failure in a Bulk Metallic Glass," Acta mater. 49 (2001) 2527-2537.
Zhao,"Simultaneously Increasing the Ductility and Strength of Nanostructured Alloys," Adv. Mater. 18 (2006), 2280 2283.
Steif, "Strain Localization in Amorphous Metals," Acta Metall. 30 (1982), 447-455.
Zhang, "Modulated oscillatory hardening and dynamic recrystallization in cryomilled nanocrystalline Zn," Acta Mater. 50 (2002), 3995-4004.
Chen, Deformation-induced nanocrystal formation in shear bands of amorphous alloys Nature 367 (1994), 541-543.
Hays, "Microstructure Controlled Shear Band Pattern Formation and Enhanced Plasticity of Bulk Metallic Glasses Containing in situ Formed Ductile Phase Dendrite Dispersions," Phys. Rev. Lett. 84 (2000), 2901-2904.
Yim, "Bulk metallic glass matrix composites," Appl. Phys. Lett. 71 (1997), 3808-3810.
Szuecs, "Mechanical Properties of Zr56.2 Ti13.8 Nb5.0 Cu6.9 Ni5.6 Be12.5 Ductile Phase Reinforced Bulk Metallic Glass Composite," Acta Mater. 49 (2001) 1507-1513.
Yavari, "FeNiB-based metallic glasses with fcc crystallisation products," Journal of Non-Crystalline Solids 304 (2002) 44-50.
Fan,"Metallic glass matrix composite with precipitated ductile reinforcement," Appl. Phys. Lett. 81 (2002) 1020-1022.
He, "Novel Ti-base nanostructure-dendrite composite with enhanced plasticity," Nature Mater. 2 (2003) 33-37.
Lee, "Effect of a controlled volume fraction of dendritic phases on tensile and compressive ductility in La-based metallic glass matrix composites," Acta Materia1ia 52 (2004) 4121-4131.
Eckert, "Strengthening of multicomponent glass-forming alloys by microstructure design," Journal of Non-Crystalline Solids 353 (2007) 3742-3749.
Qin,"Mechanical properties and corrosion behavior of (Cu0.6Hf0.25Ti0.15)90Nb10 bulk metallic glass composites," Materials Science and Engineering A449-451 (2007) 230-234.
Lee, "Reappraisal of the work hardening behavior of bulk amorphous matrix composites," Materials Science and Engineering A513-514 (2009) 160-165.
Kinaka, "High specific strength Mg-based bulk metallic glass matrix composite highly ductilized by Ti dispersoid," Materials Science and Engineering A494 (2008) 299-303.
Fan, "Ductility of bulk nanocrystalline composites and metallic glasses at room temperature," Appl. Phys. Lett. 77 (2000) 46-48.
Kim, "Role of nanometer-scale quasicrystals in improving the mechanical behavior of Ti-based bulk metallic glasses," Appl. Phys. Lett. 83 (2003) 3093-3095.
Das, "'Work-Hardenable'Ductile Bulk Metallic Glass," Phys. Rev. Lett. 94 (2005) 205501 (4 Pages).
Hajilaoui, "Ductilization of BMGs by optimization of nanoparticle dispersion," Journal of Alloys and Compounds 434-435 (2007) 6-9.
Kim, "Heterogeneity of a CU47.5Zr47.5Al5 bulk metallic glass" Applied Physics Letters 88,051911 (2006) (3 Pages).
Yao, "Superductile bulk metallic glass," Applied Physics Letters 88, 122106 (2006) (3 Pages).
Kim, "Work hardening ability of ductile Ti45Cu40Ni7.5Zr5Sn2.5 and CU47.5Zr47.5A15 bulk metallic glasses," Applied Physics Letters 89, 071908 (2006) (3 Pages).
Lee, "Extraordinary plasticity of an amorphous alloy based on atomistic-scale phase separation," Materials Science and Engineering A 485 (2008) 61-65.
Chen, "Free-volume-induced enhancement of plasticity in a monolithic bulk metallic glass at room temperature," Scripta Materialia 59 (2008) 75-78.
Hofmann, "Designing metallic glass matrix composites with high toughness and tensile ductility," Nature 451 (2008) 1085 (6 pages).
Lee, "Deformation behavior of strip-cast bulk amorphous matrix composites containing various crystalline particles," Materials Science and Engineering A 449-451 (2007) 176-180.
Flores, "Local heating associated with crack tip plasticity in Zr—Ti—Ni—Cu—Be bulk amorphous metals," J. Mater. Res., vol. 14, No. 3, Mar. 1999, p. 638-643.
Kato et al., "Synthesis and Mechanical Properties of Bulk Amorphous Zr—Al—Ni—Cu Alloys Containing ZrC Particles," Material Translations Online vo1.38 No. 09 (1 page).
Hofmann, et al., "New processing possibilities for highly toughened metallic glass matrix composites with tensile ductility," Scripta Materialia 59 (2008) 684-687.
Gould, "Cobalt alloy permanent magnets," Centre D'Information Du Cobalt, Brussels 1971 (31 pages).
Wang et al., "The effect of microstructural evolution on hardening behavior of type 17-4PH stainless steel in long-term aging at 350° C.," Materials Characterization 57 (2006) 274-280.
Sun et al, "Spinodal decomposition in Fe-25Cr-12Co-1 Si alloy under a 100 kOe magnetic field," Journal of Magnetism and Magnetic Materials 306 (2006) 69-72.
Sato, "Spinodal Decomposition and Mechanical Properties of an Austenitic Fe-30wt.%Mn-9wt.%Al-O.9wt.%C Alloy," Materials Science and Engineering, Alll (1999) 45-50.
Hono, et al., "Microalloying Effect on the Microstructure and Properties of Nanocrystalline Magnetic Materials," Proceedings of the 22nd Riso International Symposium on Materials Science: Science of Metastable and Nanocrystalline Alloys Structure, Properties and Modelling, Denmark 2001 (17 pages).
Ping, et al., "Microstructural characterization of (Fe0.5Co0.5)88Zr7B4Cu1 nanocrystalline alloys," Scripta Materialia 45 (2001) 781-786.
Yan, et al., "Evaluation of the optimum solute concentration for good glass forming ability in multicomponent metallic glasses," Materials Research Bulletin 38 (2003) 681-689.
Ohnuma, et al., "Optimization of the microstructure and properties of Co-substituted Fe—Si—B—Nb—Cu nanocrystalline soft magnetic alloys," Journal of Applied Physics vol. 93, No. II, June 2003 (9 Pages).
Valiev, "Institute of Physics of Advanced Materials," Nature Materials vol. 3, Aug. 2004 (p. 511-516).
Wang et al., "High tensile ductility in a Nanostructured Metal," Letters to Nature vol. 419, Oct. 31, 2002 (p. 912-915).
Lu et al., "Ultrahigh strenght and high electrical conductivity in copper," Science, vol. 304, Apr. 16, 2004 (p. 422-426).

* cited by examiner a)

b)

c)

d)

e)

a)

b)

c)

d)

e)

MECHANISM OF STRUCTURAL FORMATION FOR METALLIC GLASS BASED COMPOSITES WITH ENHANCED DUCTILITY

CROSS-REFERENCE TO RELATED APPLICATIONS

This application claims the benefit of U.S. Provisional Patent Application Ser. No. 61/107,037, filed on Oct. 21, 2008, which is fully incorporated herein by reference.

FIELD OF INVENTION

The present invention relates the formation of spinodal microconstituent structures in a metallic glass matrix which exhibit combinations of relatively high tensile strength and relatively high elongation

BACKGROUND

Metallic nanocrystalline materials and metallic glasses exhibit relatively high hardness and strength characteristics for metal-based materials and because of this, they are considered to be potential candidates for structural applications. However, their limited fracture toughness and ductility associated with the rapid propagation of shear bands and/or cracks may be a concern for the commercial utilization of their superior strength. Typically, these materials may exhibit adequate ductility by testing in compression while tensile ductility of the same materials may be close to zero. At the same time, tensile ductility along with fracture toughness is understood to be a relatively important characteristic for structural applications where intrinsic ductility is needed to avoid catastrophic failure.

Nanocrystalline materials may be understood to be or include polycrystalline structures with a mean grain size below 100 nm. They have been the subject of widespread research since mid-1980s when it was asserted that metals and alloys, if made nanocrystalline, may exhibit a number of appealing mechanical characteristics of potential significance for structural applications. But despite relatively attractive properties (high hardness, yield stress and fracture strength), it is understood that they may show a disappointingly low tensile elongation and may tend to fail in a relatively brittle manner. In fact, empirical correlations between the work hardening exponent and the grain size for cold rolled and conventionally recystallized mild steels indicate a decrease in ductility for decreasing grain size. As the grain size is progressively decreased, the formation of dislocation pile-ups may become more difficult, limiting the capacity for strain hardening. That may lead to mechanical instability of materials under loading.

Attempts to improve the ductility of nanocrystalline materials while maintaining their relatively high strength by adjusting the microstructure have also been made. It has been proposed that an increased content of high-angle grain boundaries in nanocrystalline materials could be beneficial to an increase in ductility. In a search to improve ductility of nanocrystalline materials, extremely ductile base metals have been used. For example, nanocrystalline Cu with a bimodal grain size distribution (100 nm and 1.7 μm) has been fabricated based on the thermomechanical treatment of severe plastic deformation, which may exhibit a 65% total elongation to failure and may retain a relative high strength. Recently, a nanocrystalline Cu with nanometer sized twins embedded in submicrometer grained matrix by pulsed electrodepositon has been produced. The ductility and relatively high strength may be attributed to the interaction of glide dislocations with twin boundaries. In a recent approach, nanocrystalline second-phase particles of 4-10 nm were incorporated into the nanocrystalline Al matrix (about 100 nm). The nanocrystalline particles interacted with the slipping dislocation and enhanced the strain hardening rate which leads to the evident improvement of ductility. Using these approaches, enhanced tensile ductility has been achieved in a number of nanocrystalline materials such as 15% in pure Cu with mean grain size of 23 nm or 30% in pure Zn with mean grain size of 59 nm. It should be noted that fracture strength of these nanocrystalline materials does not exceed 1 GPa. For nanocrystalline materials with higher fracture strength (1 GPa) the achievement of adequate ductility (>1%) may still be a challenge.

Amorphous metallic alloys (metallic glasses) represent a relatively young class of materials, having been first reported around 1960 when classic rapid-quenched experiments were performed on Au—Si alloys. Since that time, there has been progress in exploring alloys compositions for glass formers, seeking elemental combinations with ever-lower critical cooling rates for the retention of an amorphous structure. Due to the absence of long-range order, metallic glasses may exhibit relatively unique properties, such as relatively high strength, high hardness, large elastic limit, good soft magnetic properties and high corrosion resistance. However, owing to strain softening and/or thermal softening, plastic deformation of metallic glasses may be highly localized into shear bands, which may result in a limited plastic strain (less than 2%) and may lead to catastrophic failure at room temperature.

Different approaches have been applied to enhance ductility of metallic glasses such as introducing free volume in amorphous structure or glassy phase separation which has enabled up to 25% in compression. However, tensile ductility for these materials has not been reported. Another approach is the development of metallic glass matrix composites. Crystalline precipitates may be introduced into a glass matrix by partial crystallization. Crystallization occurs by nucleation and growth mechanism and depending on glass composition and crystallization kinetics, nanometer-sized or micrometer-sized crystallities might be introduced.

This approach may also allow an increase in compressive ductility in Ti-based, Zr-based, Mg-based glasses and Cu—Hf—Ti—Nb system. Tensile ductility of these materials was demonstrated up to 13% tensile elongation in Ti—Zr-based metallic glasses with large dendrites (20-50 μm in size) embedded in the glassy matrix. The heterogeneous structure of these composites may act as an initiation site for the formation of shear bands and/or a barrier to the rapid propagation of shear bands, which leads to enhancement of global plasticity, but sometimes decreases the strength.

Another way to reduce grain size is through spinodal decomposition which may occur when a mixture of two or more materials separate into distinct regions with different material concentrations. This method differs from nucleation in that phase separation due to spinodal decomposition may occur throughout the material, and not just at nucleation sites. Spinodal decomposition was previously observed in AlNiCo magnets, 17-4PH stainless steel, Fe-25Cr-12Co-1Si alloy, and Fe-based austenitic alloy. Recent studies mentioned a Co enrichment in the amorphous residual matrix and Fe enrichment in the α'-FeCo crystalline phase. In addition, experimental evidence of grain refinement caused by the formation of clusters, which, in turn, resulted from the addition of >1% Cu has been presented. It has also been shown that Cu additions of more than 1.0% promoted the formation of clusters responsible for the grain refinement of the crystalline α'-FeCo phase, i.e., grain size around 10 nm. However, no property evaluation of the final structure was performed in these studies. With respect to AlNiCo magnets, while it is known from a number of sources that relatively high tensile strengths can be obtained from 28 to 380 MPa, the material response may be somewhat brittle and tensile elongation data is generally not listed.

SUMMARY

An aspect of the present disclosure relates to an alloy composition, which may include 52 atomic percent to 68 atomic percent iron, 13 to 21 atomic percent nickel, 2 to 12 atomic percent cobalt, 10 to 19 atomic percent boron, optionally 1 to 5 atomic percent carbon, and optionally 0.3 to 16 atomic percent silicon. The alloy may include 5 to 95% by volume of one or more spinodal microconstituents, wherein the microconstituents exhibit a length scale less than 50 nm in a glass matrix.

Another aspect of the present disclosure relates to a method of forming spinodal microconstituents in an alloy. The method may include melting alloy constituents including 52 atomic percent to 60 atomic percent iron, 15.5 to 21 atomic percent nickel, 6.3 to 11.6 atomic percent cobalt, 10.3 to 13.2 atomic percent boron, 3.7 to 4.8 atomic percent carbon, and 0.3 to 0.5 atomic percent silicon to form an alloy, and cooling the alloy to form one or more spinodal microconstituents in a glass matrix. The spinodal microconstituents may be present in the range of 5% to 95% by volume and exhibit a length scale less than 50 nm in a glass matrix.

BRIEF DESCRIPTION OF DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

Figure 1A:
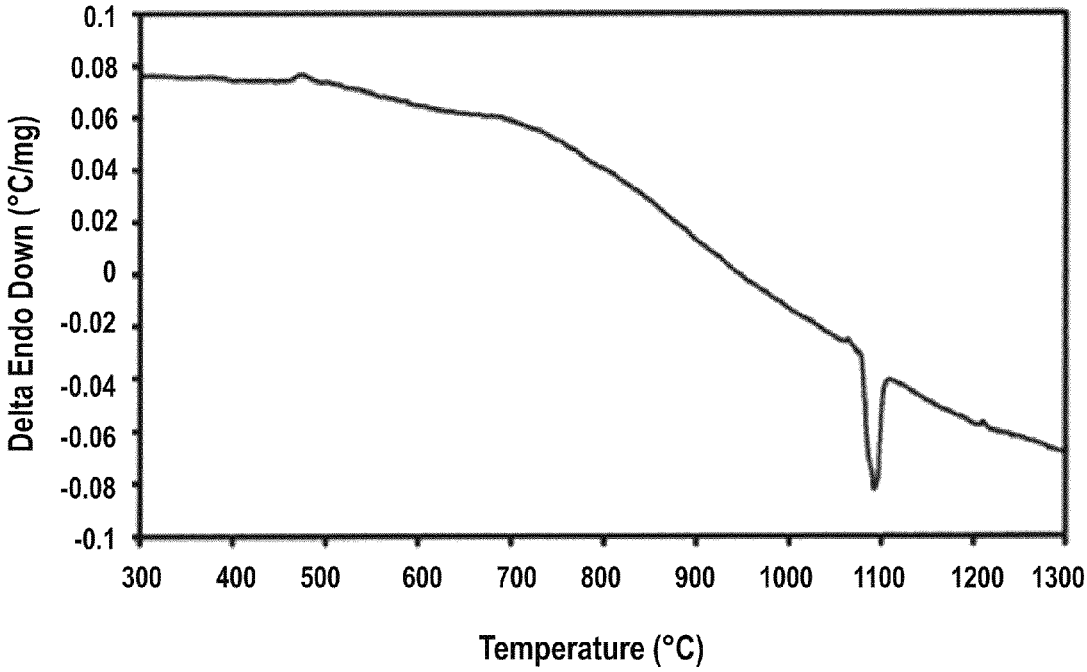
FIG. 1 illustrates DTA curves of examples of alloys contemplated herein melt-spun at 16 m/s showing the presence of glass to crystalline transformation peak(s) and in some cases melting peak(s); wherein FIG. 1*a*) illustrates a DTA curve of alloy PC7E4A9, FIG. 1*b*) illustrates a DTA curve of alloy PC7E4C3, FIG. 1*c*) illustrates a DTA curve of alloy PC7E6H9, FIG. 1*d*) illustrates a DTA curve of alloy PC7E6J1, FIG. 1*e*) illustrates a DTA curve of alloy PC7E7.
Figure 1B:
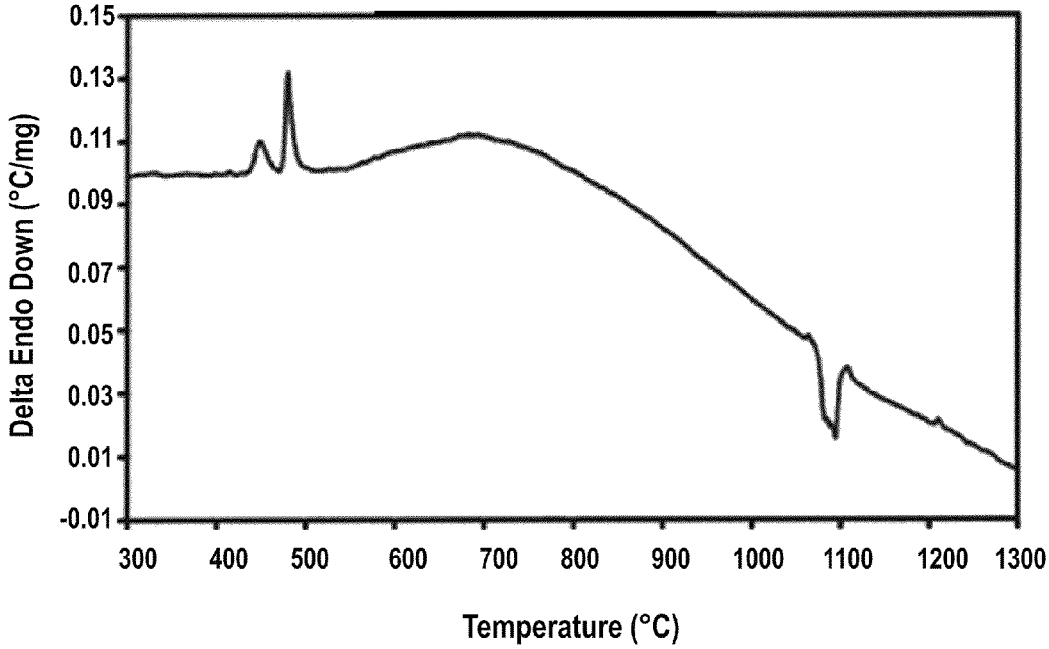
Figure 1C:
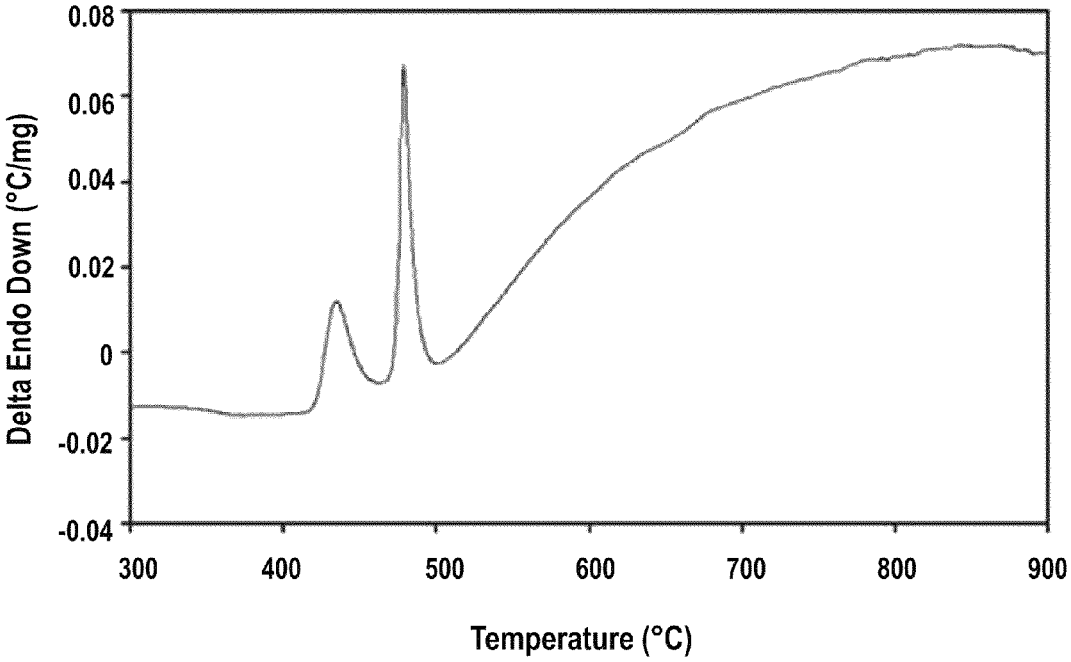
Figure 1D:
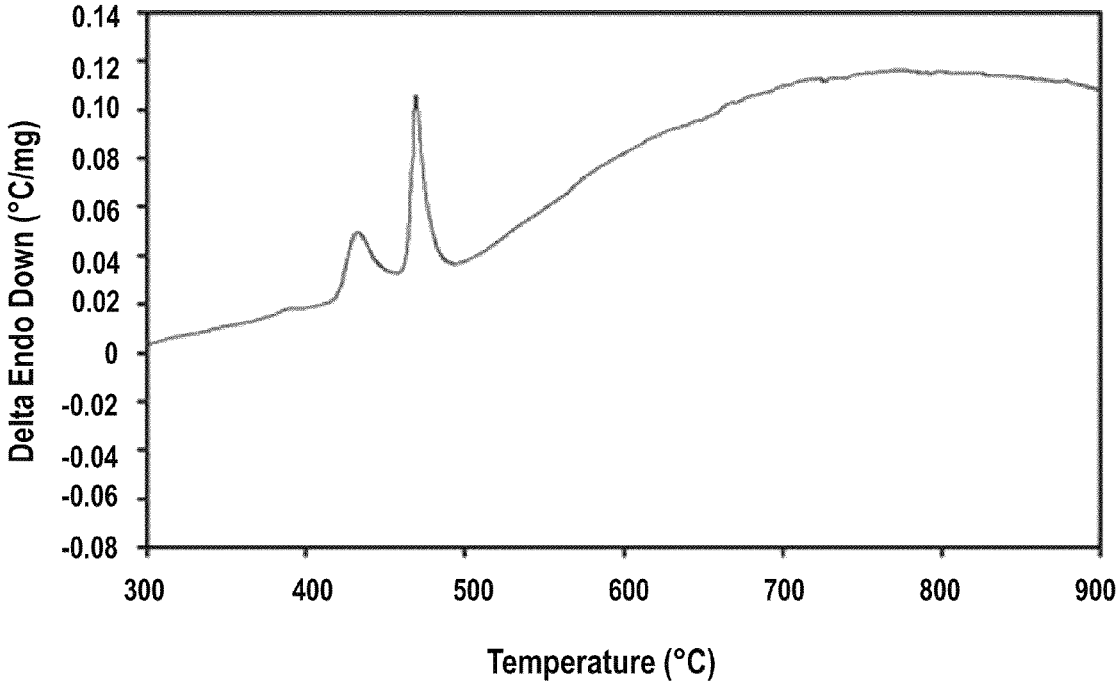
Figure 1E:
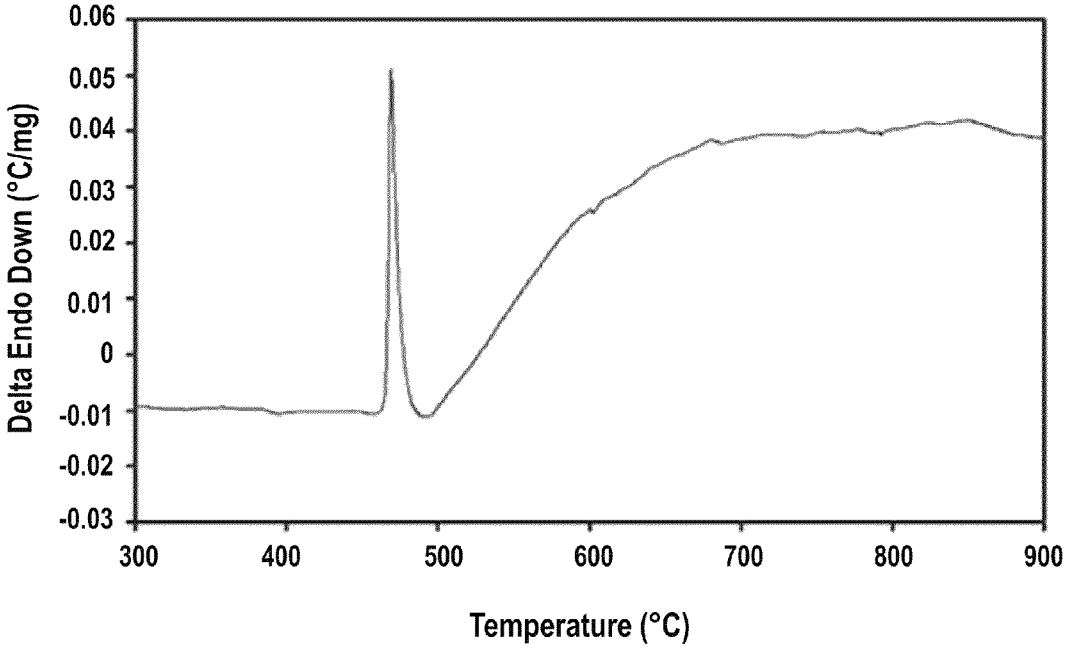
Figure 2A:
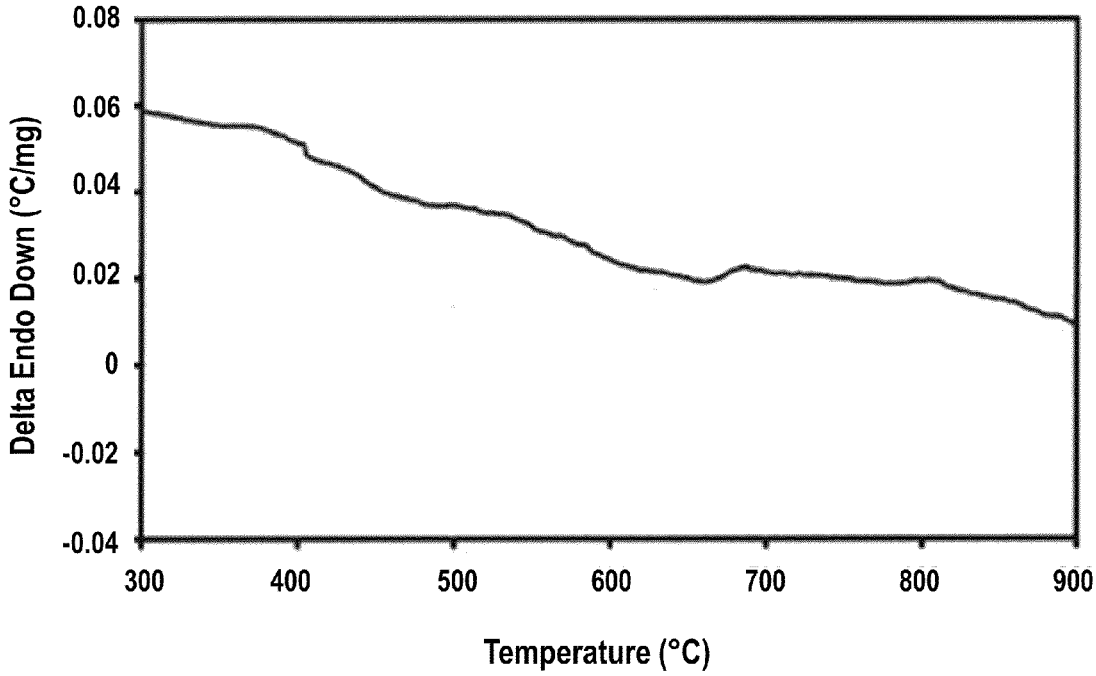
FIG. 2*a*) illustrates a DTA curve of PC7E4A9, FIG. 2*b*) illustrates a DTA curve of PC7E4C3, FIG. 2*c*) illustrates a DTA curve of PC7E6H9, FIG. 2*d*) illustrates a DTA curve of PC7E6J1, FIG. 2*e*) illustrates a DTA curve of PC7E7.
Figure 2B:
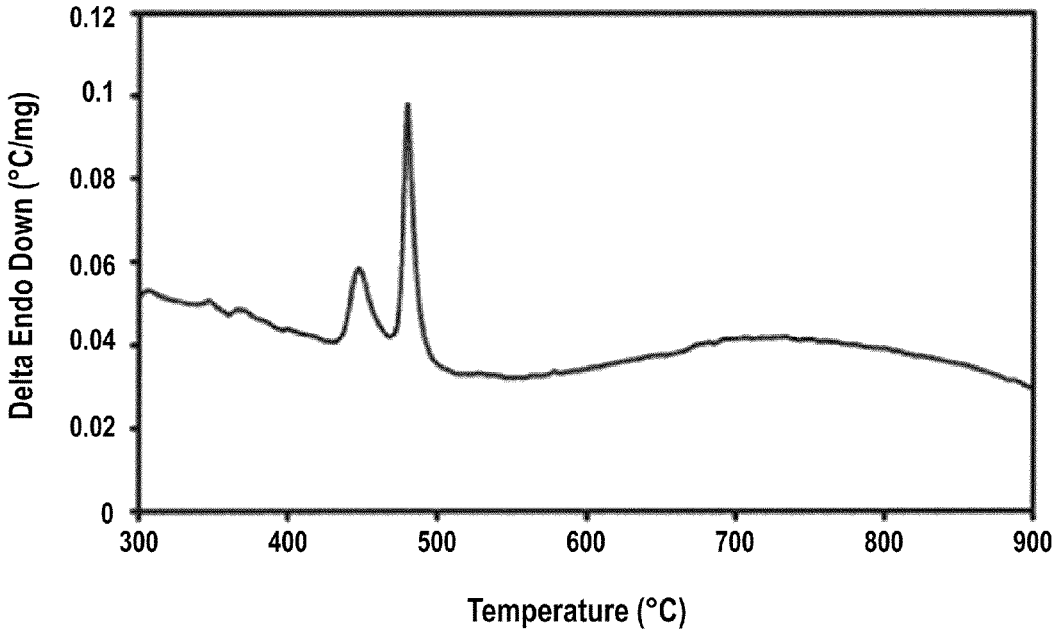
FIG. 2 illustrates DTA curves of examples of the alloys melt-spun at 10.5 m/s showing the presence of glass to crystalline transformation peak(s) and in some cases melting peak(s)
Figure 2C:
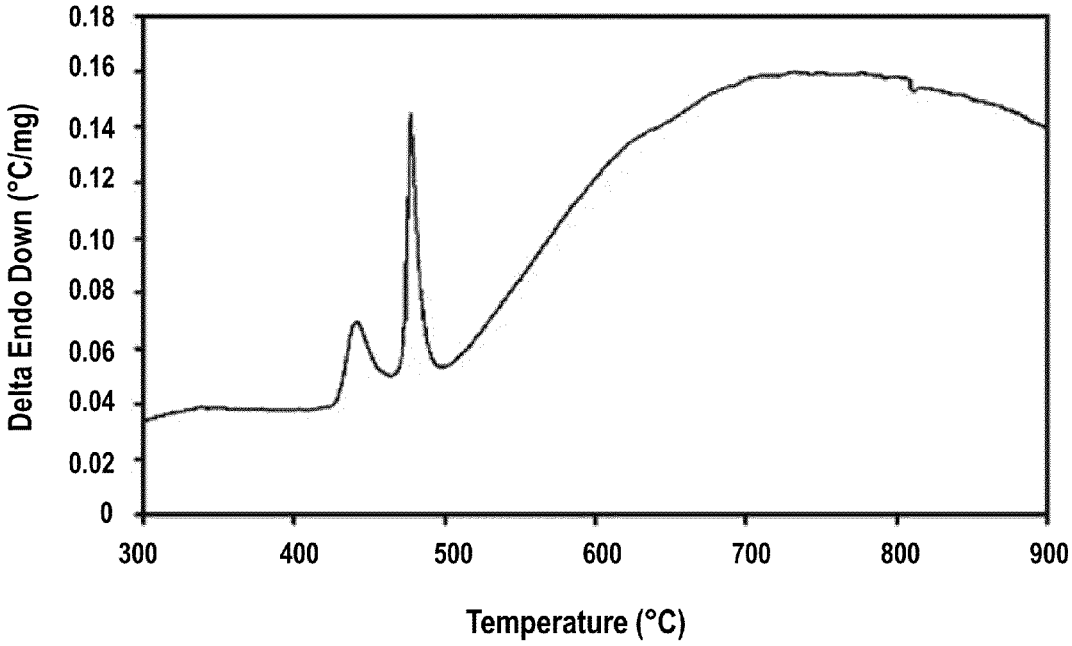
Figure 2D:
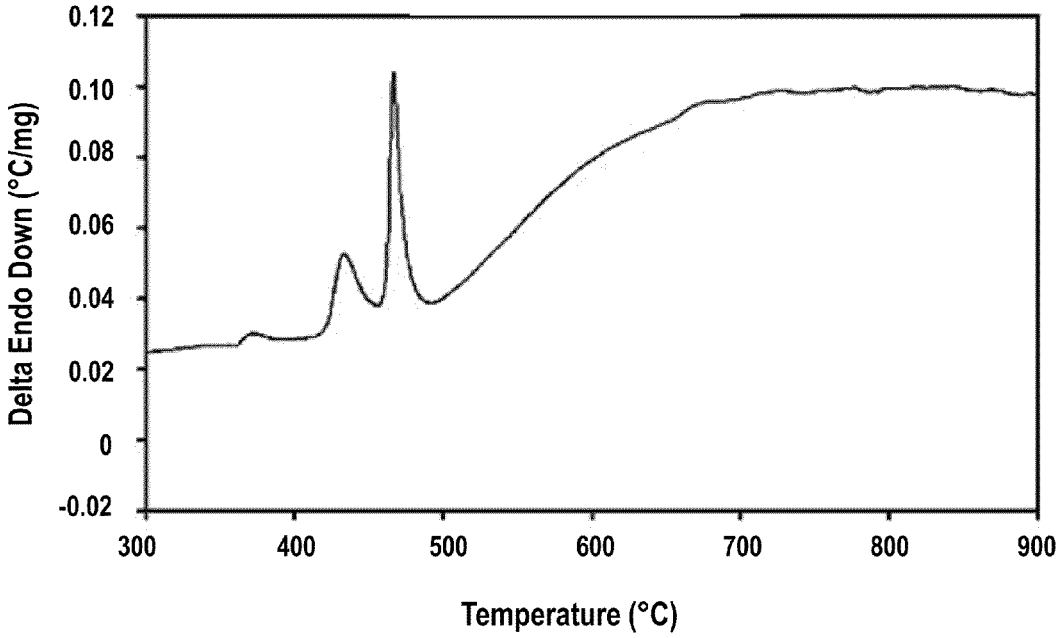
Figure 2E:
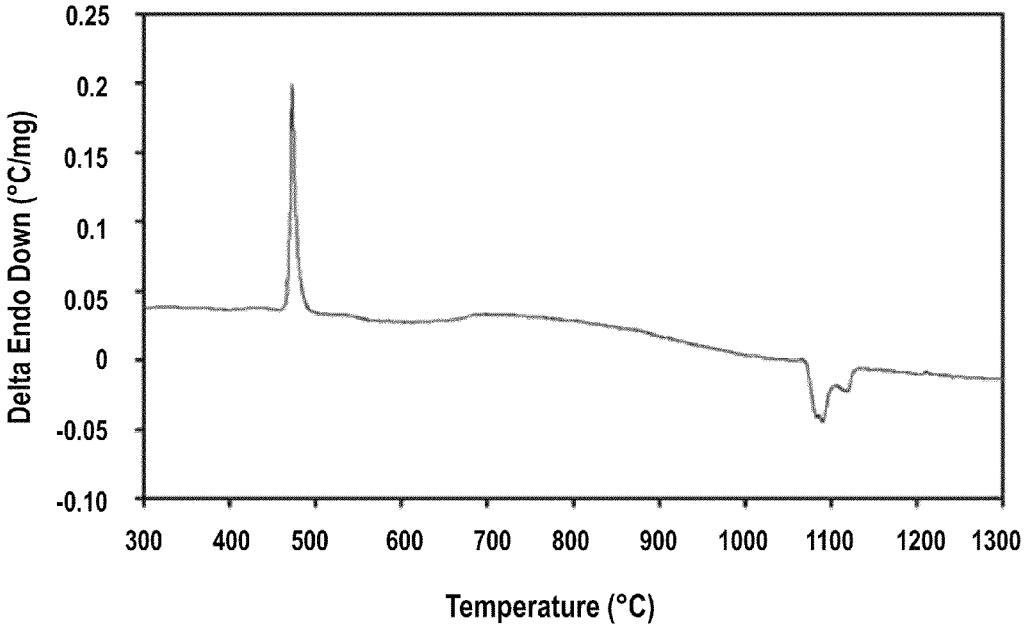
Figure 3:
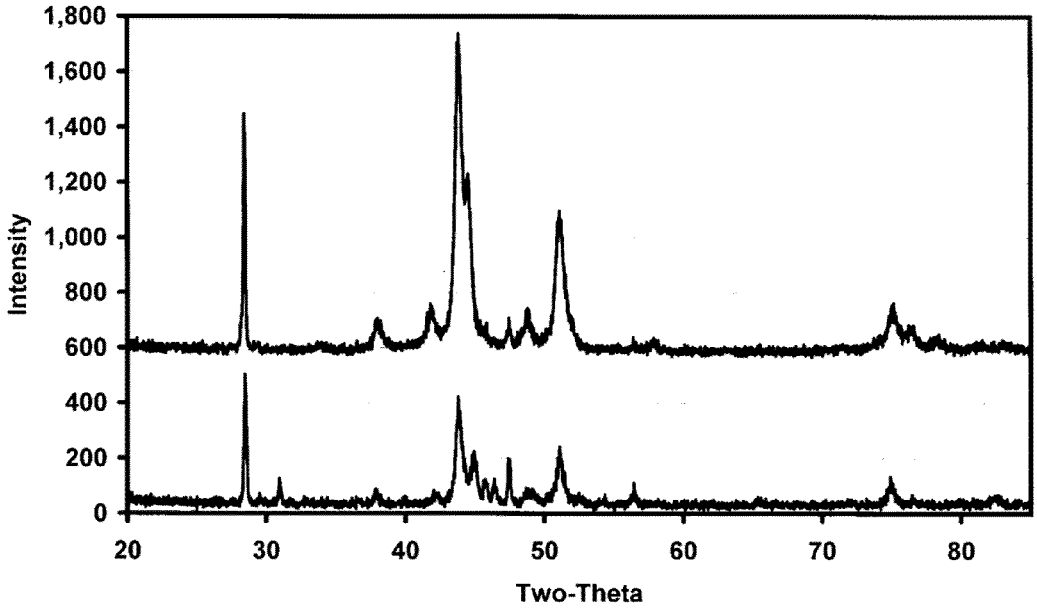
FIG. 3 illustrates an example of X-ray diffraction scans of the PC7E4A9 sample melt-spun at 16 m/s; top curve free side, bottom curve wheel side.
Figure 4:
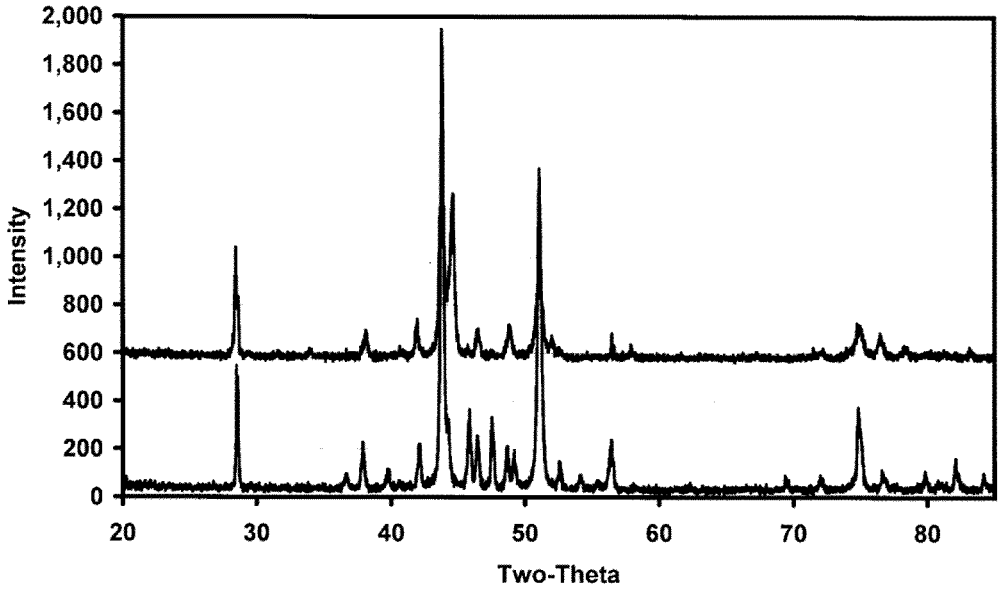
FIG. 4 illustrates an example of X-ray diffraction scans of the PC7E4A9 sample melt-spun at 10.5 m/s; top curve free side, bottom curve wheel side.
Figure 5:
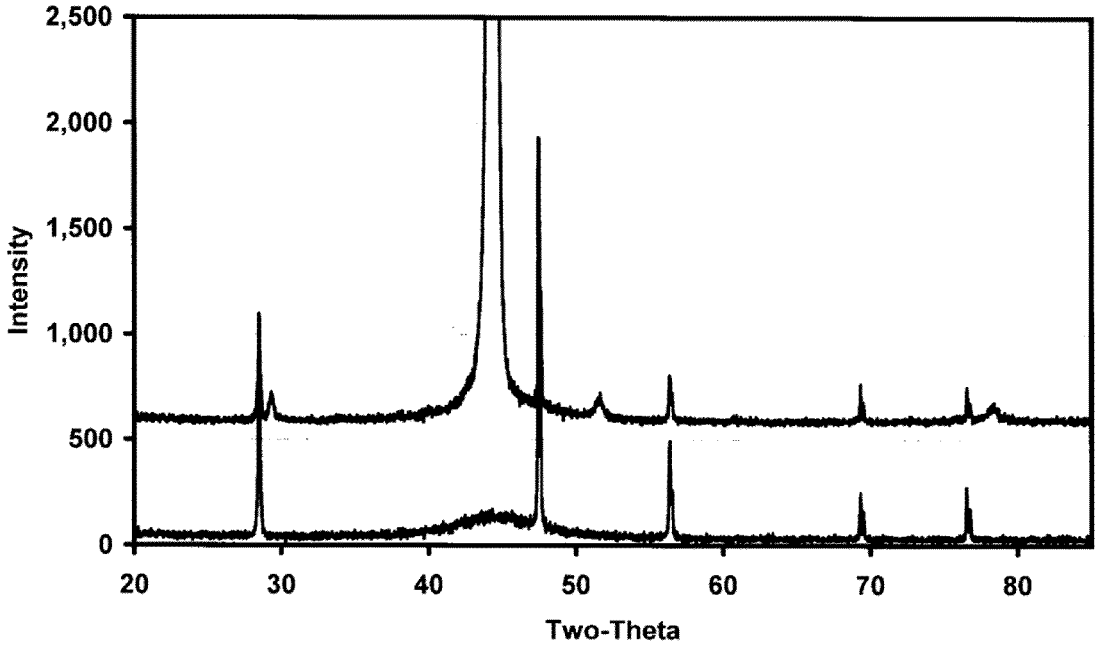
FIG. 5 illustrates an example of X-ray diffraction scans of the PC7E4C3 sample melt-spun at 16 m/s; top curve free side, bottom curve wheel side.
Figure 6:
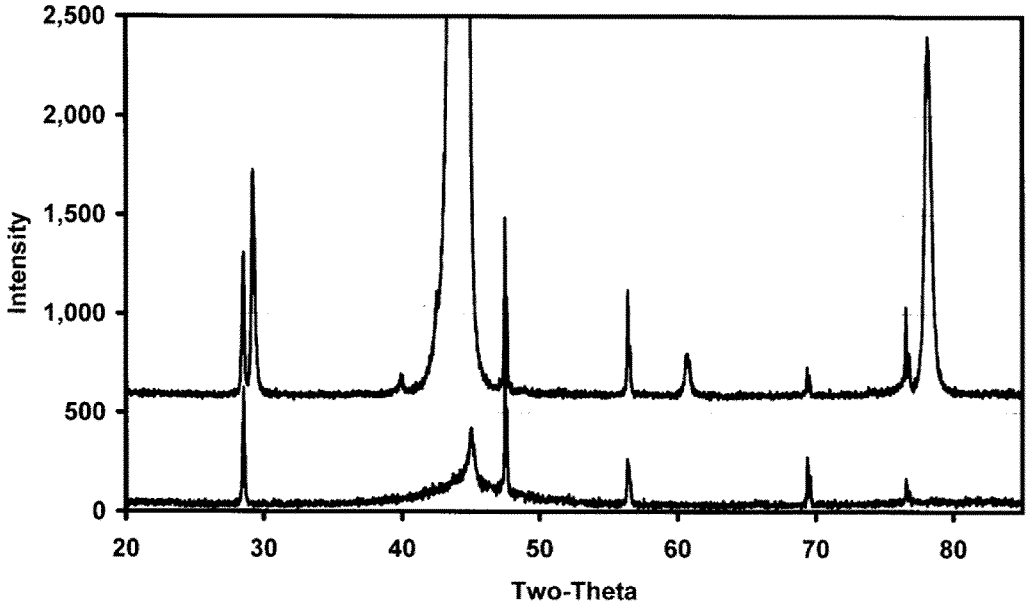
FIG. 6 illustrates an example of X-ray diffraction scans of the PC7E4C3 sample melt-spun at 10.5 m/s; top curve free side, bottom curve wheel side.
Figure 7:
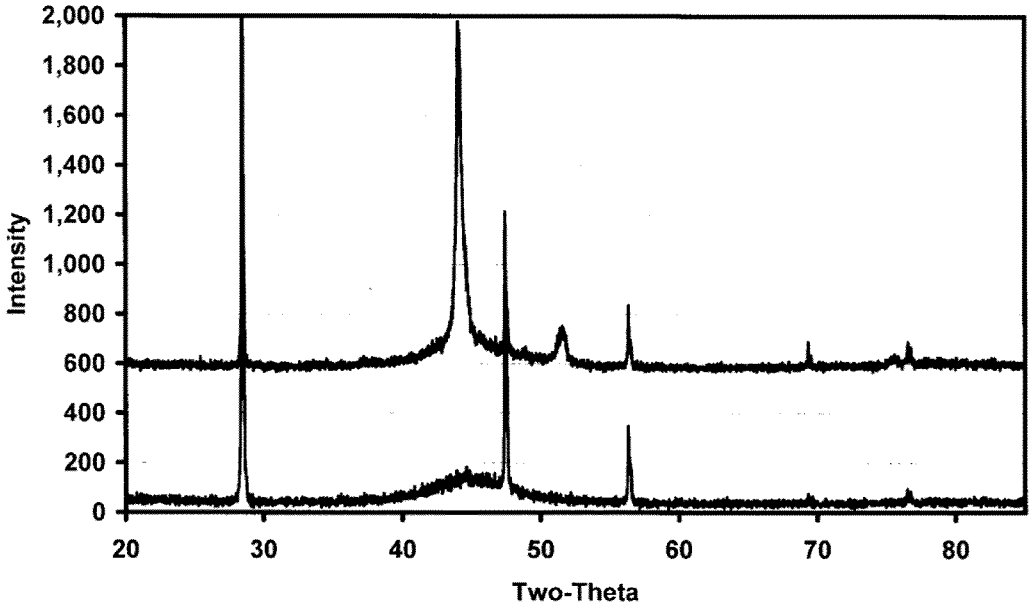
FIG. 7 illustrates an example of X-ray diffraction scans of the PC7E6H9 sample melt-spun at 16 m/s; top curve free side, bottom curve wheel side.
Figure 8:
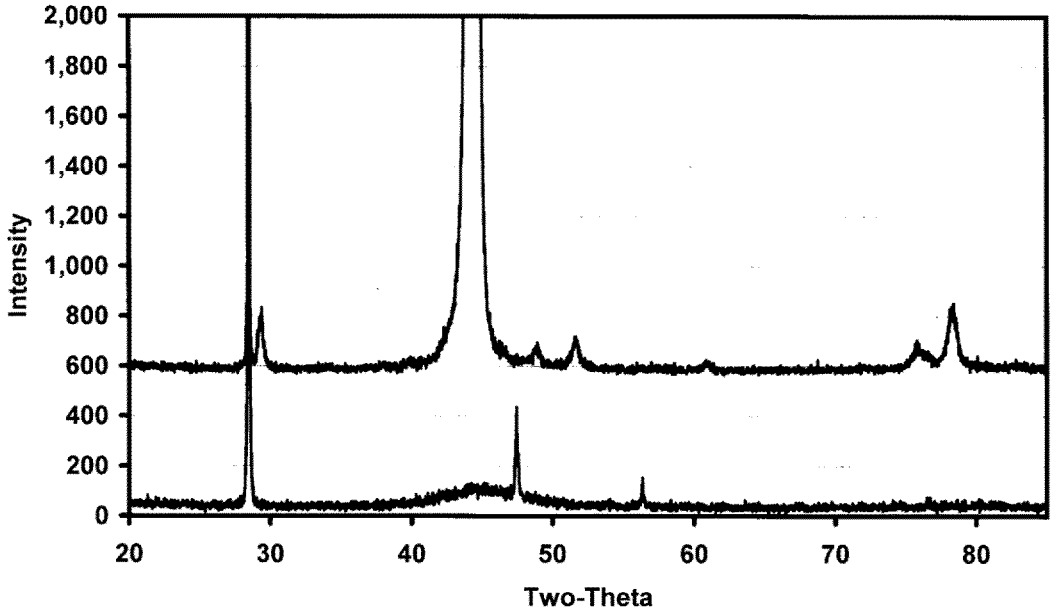
FIG. 8 illustrates an example of X-ray diffraction scans of the PC7E6H9 sample melt-spun at 10.5 m/s; top curve free side, bottom curve wheel side.
Figure 9:
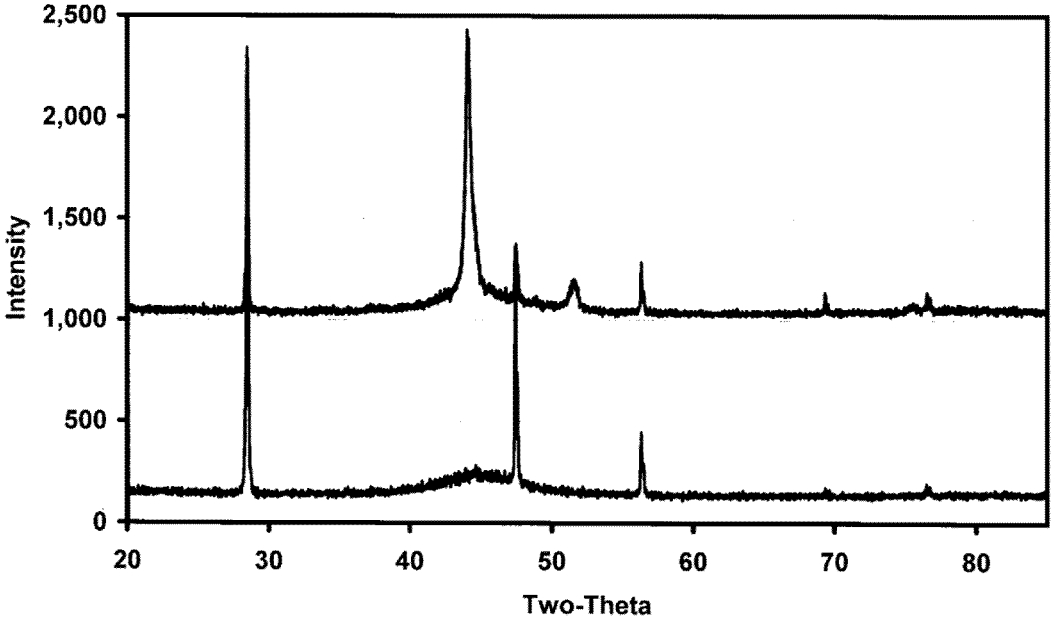
FIG. 9 illustrates an example of X-ray diffraction scans of the PC7E6J1 sample melt-spun at 16 m/s; top curve free side, bottom curve wheel side.
Figure 10:
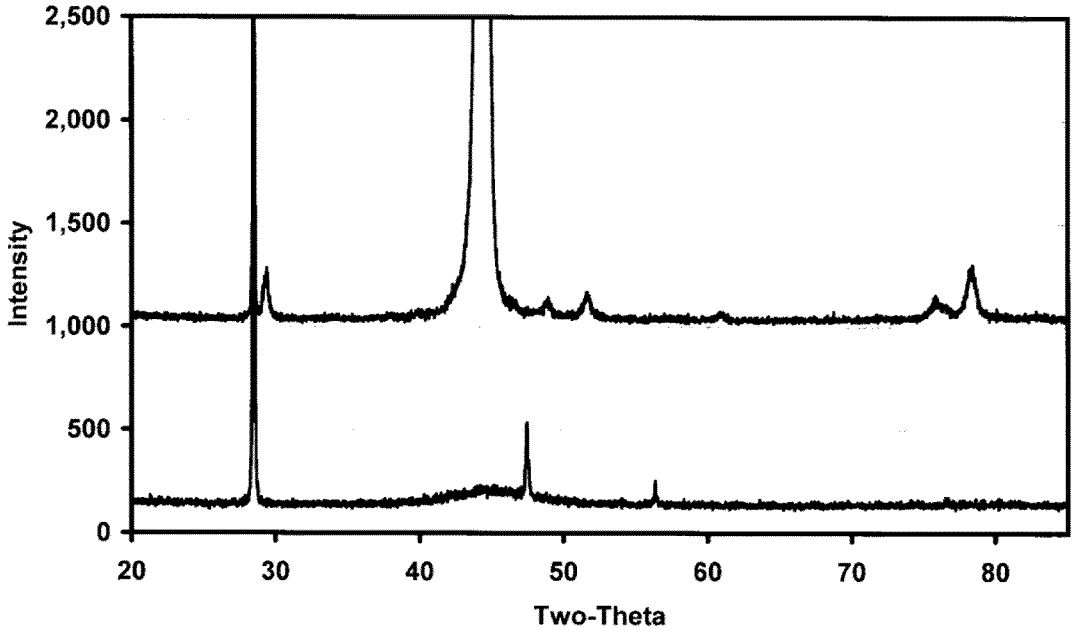
FIG. 10 illustrates an example of X-ray diffraction scans of the PC7E6J1 sample melt-spun at 10.5 m/s; top curve free side, bottom curve wheel side.
Figure 11:
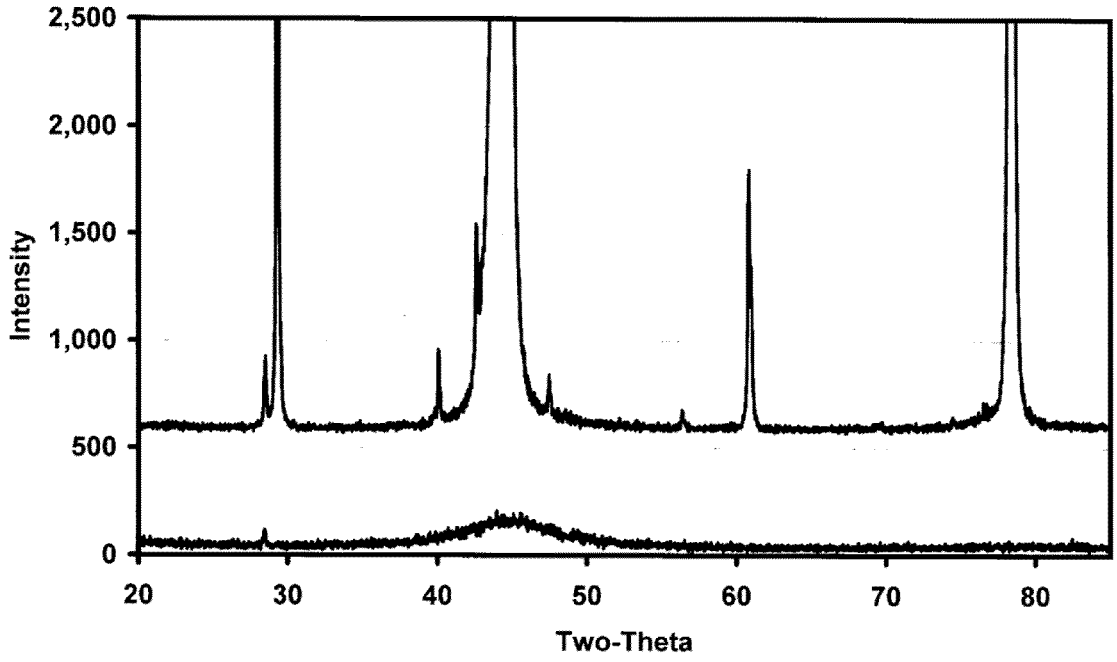
FIG. 11 illustrates an example of X-ray diffraction scans of the PC7E7 sample melt-spun at 16 m/s; top curve free side, bottom curve wheel side.
Figure 12:
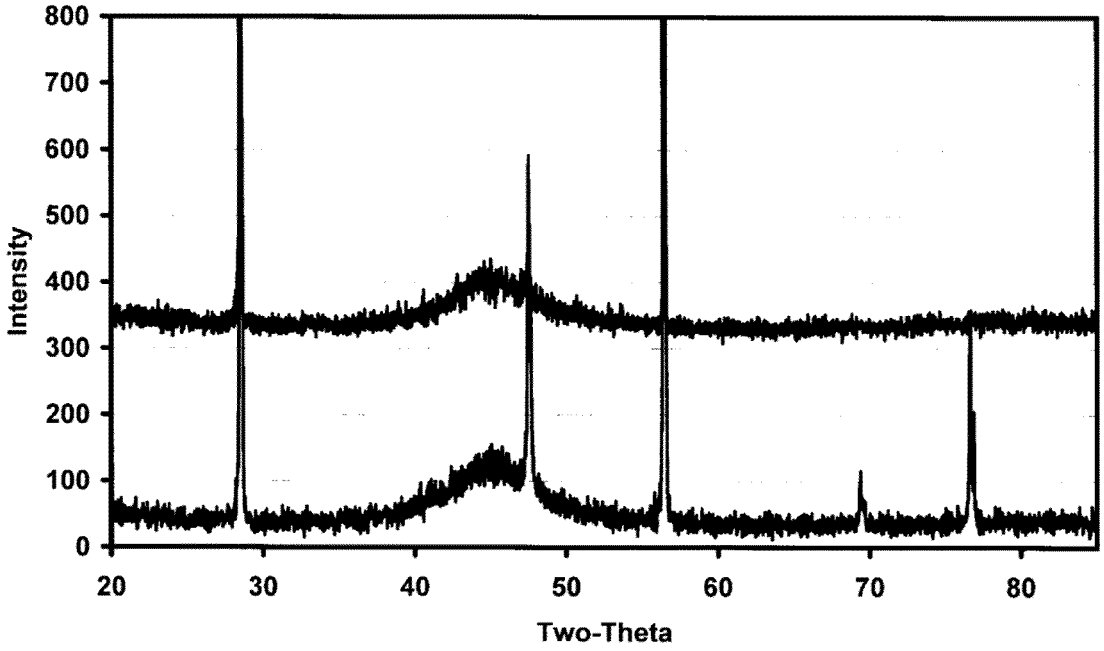
FIG. 12 illustrates an example of X-ray diffraction scans of the PC7E7 sample melt-spun at 10.5 m/s; top curve free side, bottom curve wheel side.
Figure 13:
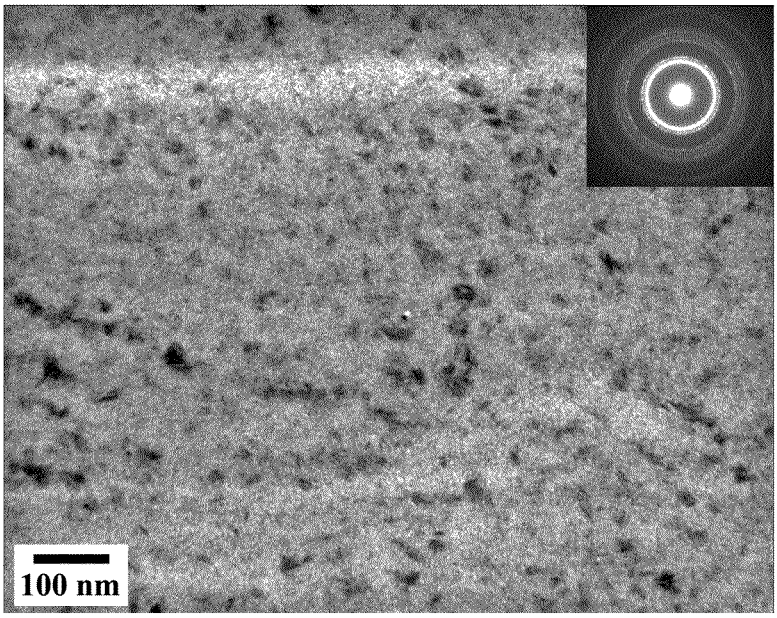
FIG. 13 illustrates an example of a TEM micrograph of PC7E4A9 which was melt-spun at 16 m/s.
Figure 14:
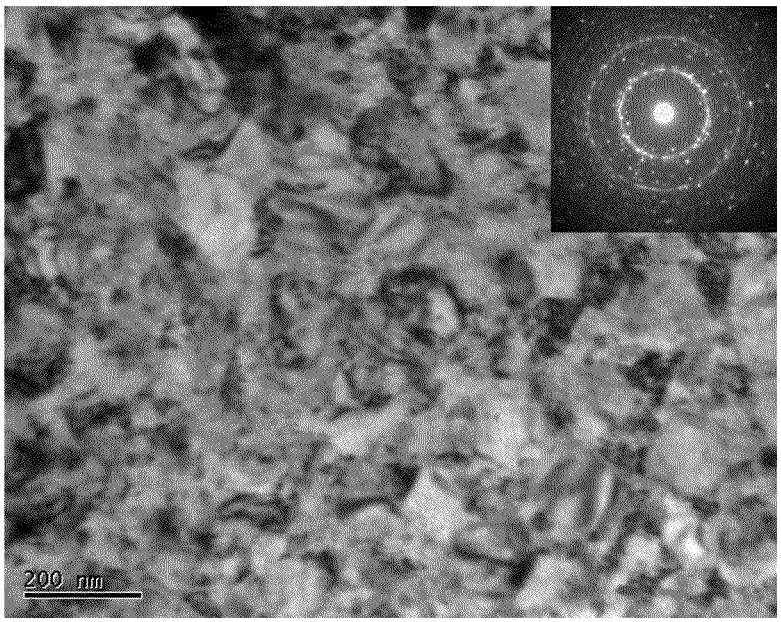
FIG. 14 illustrates an example of a TEM micrograph of PC7E4A9 which was melt-spun at 10.5 m/s.
Figure 15:
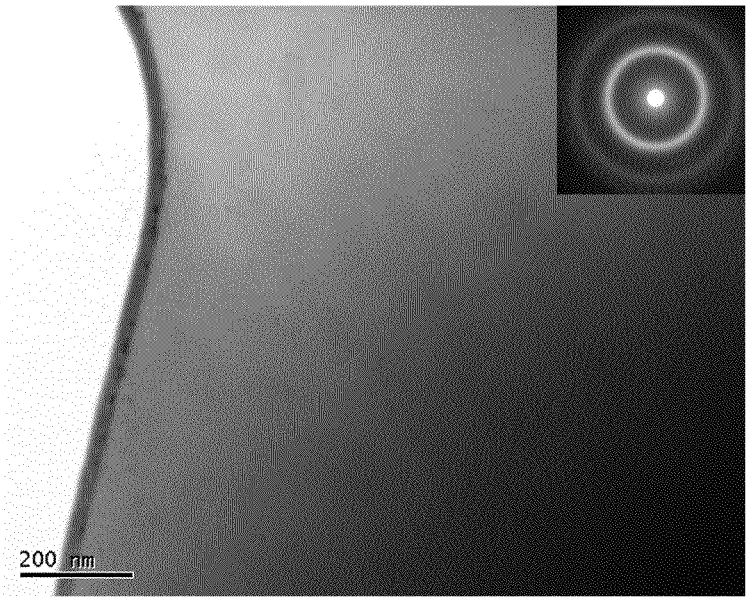
FIG. 15 illustrates an example of a TEM micrograph of PC7E4C3 which was melt-spun at 16 m/s.
Figure 16:
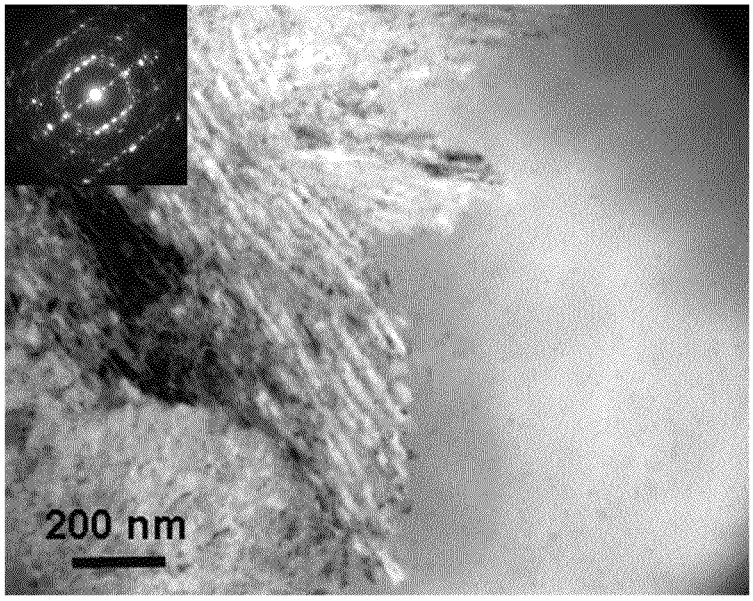
FIG. 16 illustrates an example of a TEM micrograph of PC7E4C3 which was melt-spun at 10.5 m/s.
Figure 17:
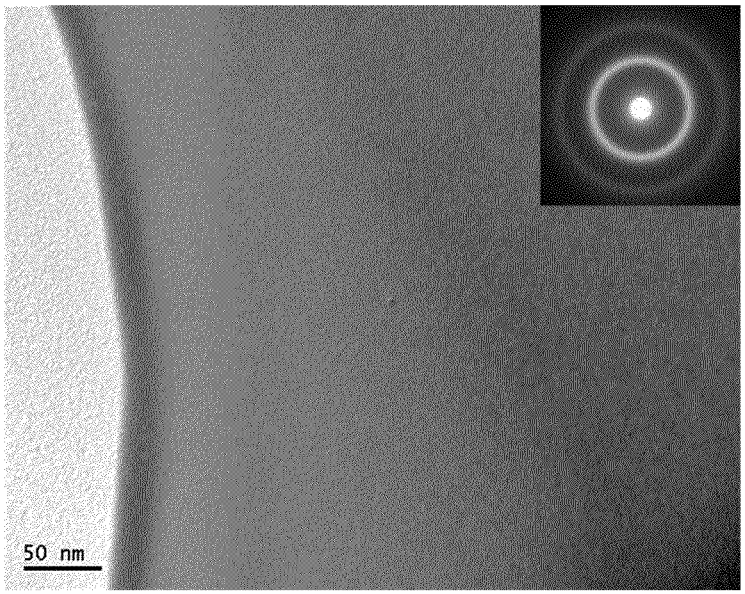
FIG. 17 illustrates an example of a TEM micrograph of PC7E6H9 which was melt-spun at 16 m/s.
Figure 18:
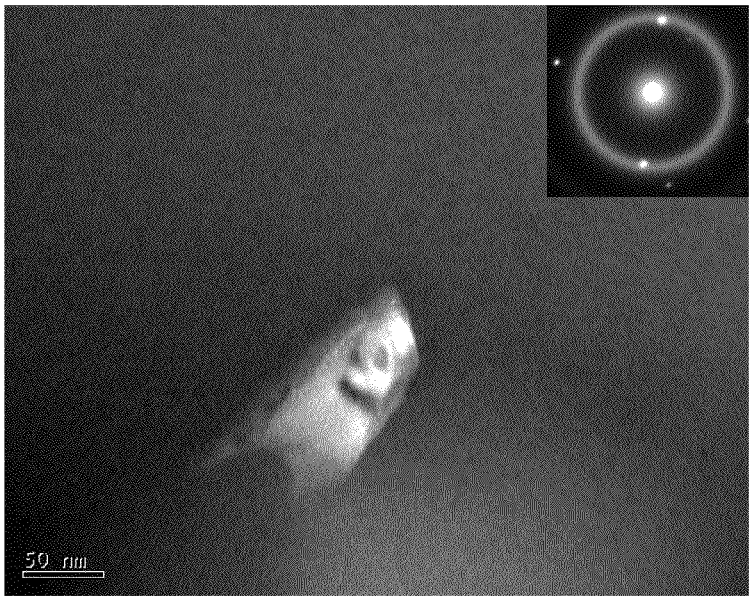
FIG. 18 illustrates an example of a TEM micrograph of PC7E6H9 which was melt-spun at 10.5 m/s.
Figure 19:
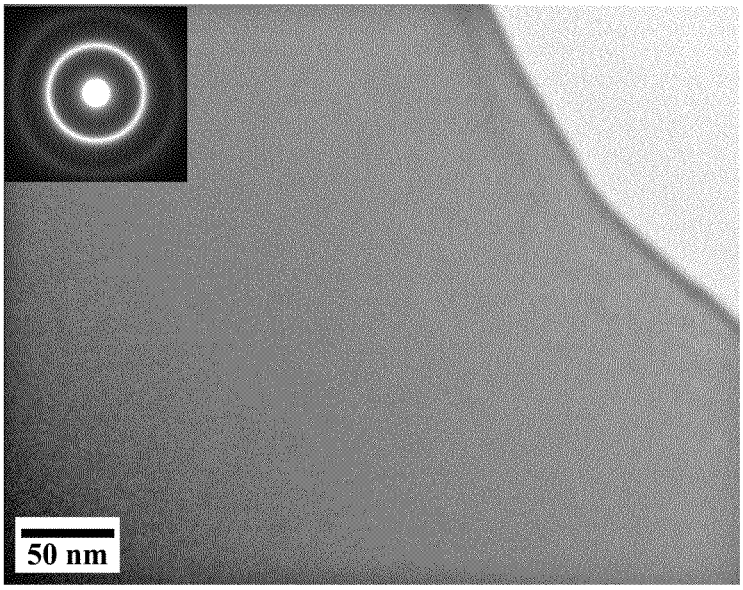
FIG. 19 illustrates an example of a TEM micrograph of PC7E6J1 which was melt-spun at 16 m/s.
Figure 20:
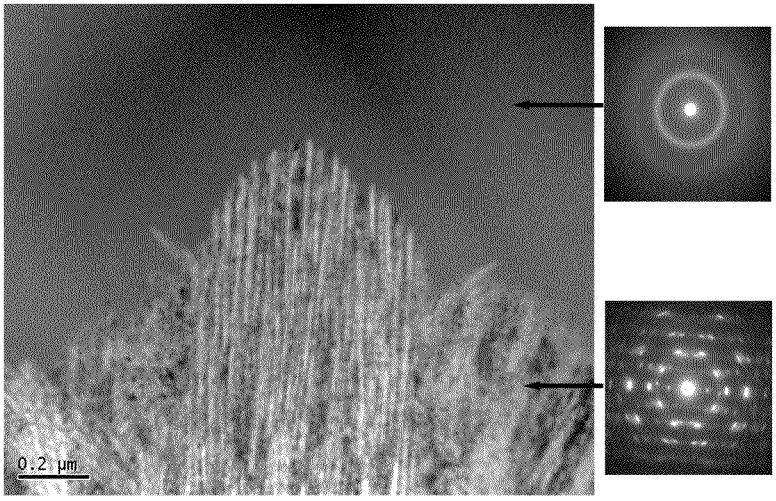
FIG. 20 illustrates an example of a TEM micrograph of PC7E6J1 which was melt-spun at 10.5 m/s.
Figure 21:
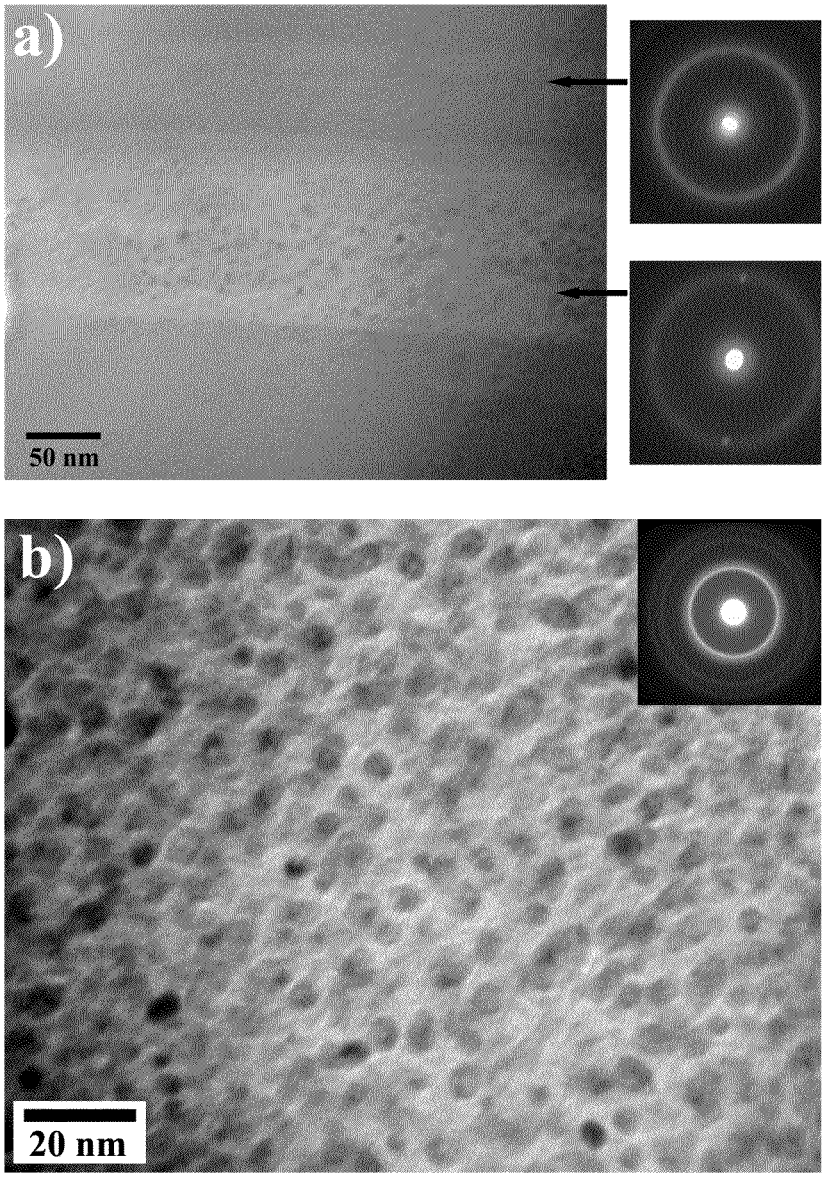
FIG. 21 illustrates an example of a TEM micrograph of PC7E7 which was melt-spun at 16 m/s; a) Sample 1 in center showing a band of nanocrystalline microconstituent region (i.e. spinodal decomposition) around a fully amorphous layer, b) Sample 2 in center showing nanocrystalline phases in a glass matrix (i.e. spinodal decomposition).
Figure 22:
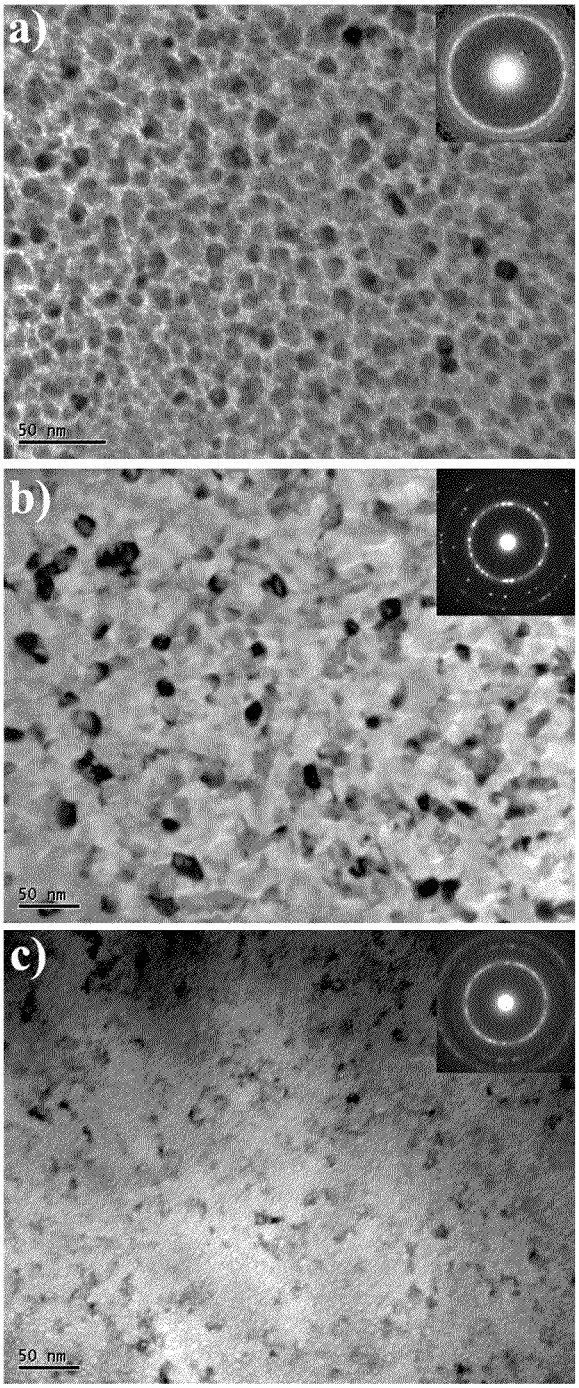
FIG. 22 illustrates an example of TEM micrographs of PC7E7 which was melt-spun at 10.5 m/s; a) Sample 1 exhibiting crystalline phases in a glass matrix (i.e. spinodal decomposition), b) Sample 2 exhibiting a fully devitrified region from nucleation and growth, c) Sample 3 exhibiting a partially transformed region with small uniform phases in a glass matrix (partially transformed spinodal decomposition).

The present disclosure relates to a glass forming alloy which may transform to yield at least a portion of its structure as a spinodal microconstituent, which may consist of one or more crystalline phases at a length scale less than 50 nm in a glass matrix. Stated another way, any given dimension of the crystalline phases may be in the range of 1 nm to less than 50 nm including all values and increments therein, such as 1 nm, 2 nm, 3 nm 4 nm, 5 nm, 6 nm, 7 nm, 8 nm, 9 nm, 10 nm, 11 nm, 12 nm, 13 nm, 14 nm, 15 nm, 16 nm, 17 nm, 18 nm, 19 nm, 20 nm, 21 nm 22 nm 23 nm, 24 nm, 25 nm, 26 nm, 27 nm, 28 nm, 29 nm, 30 nm, 40 nm, 41 nm, 42 nm, 43 nm, 44 nm, 45 nm, 46 nm, 47 nm, 48 nm, 49 nm. In addition, the alloy may include one or more of spinodal microconstituents present in the range of ~5 to ~95% by volume, including 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%. Spinodal microconstituents may be understood as microconstituents formed by a transformation mechanism which is not nucleation controlled. More basically, spinodal decomposition may be understood as a mechanism by which a solution of two or more components (e.g. metal compositions) of the alloy can separate into distinct regions (or phases) with distinctly different chemical compositions and physical properties. This mechanism differs from classical nucleation in that phase separation occurs uniformly throughout the material and not just at discrete nucleation sites. One or more semicrystalline clusters or crystalline phases may therefore form through a successive diffusion of atoms on a local level until the chemistry fluctuations lead to at least one distinct crystalline phase. Semi-crystalline clusters may be understood herein as exhibiting a largest linear dimension of 2 nm or less, whereas crystalline clusters may exhibit a largest linear dimension of greater than 2 nm. Note that during the early stages of the spinodal decomposition, the clusters which are formed are small and while their chemistry differs from the glass matrix, they are not yet fully crystalline and have not yet achieved well ordered crystalline periodicity. Additional crystalline phases may exhibit the same crystal structure or distinct structures.

Glass forming alloys that may provide spinodal microconstituent formation may include the following constituents: 52 to 68 atomic percent (at %) iron, 13 to 21 at % nickel, 2 to 12 at % cobalt, 10 to 19 at % boron, 1 to 5 at % carbon if present, 0.3 to 16 at % silicon if present, including all values and increments of 0.1 atomic percent within the above ranges. For example, the glass forming alloys may include 52 atomic percent to 60 atomic percent iron 15.5 to 21 atomic percent nickel, 6.3 to 11.6 atomic percent cobalt, 10.3 to 13.2 atomic percent boron, 3.7 to 4.8 atomic percent carbon; and 0.3 to 0.5 atomic percent silicon. In another example, the glass forming alloys may include 58.4 atomic percent to 67.6 atomic percent iron, 16.0 to 16.6 atomic percent nickel, 2.9 to 3.1 atomic percent cobalt, 12.0 to 18.5 atomic percent boron, optionally 1.5 to 4.6 atomic percent carbon, and optionally 0.4 to 3.5 atomic percent silicon. In yet a further example, the glass forming alloys may include 53.6 atomic percent to 60.9 atomic percent iron, 13.6 to 15.5 atomic percent nickel, 2.4 to 2.9 atomic percent cobalt, 12 to 14.1 atomic percent boron, 1 to 4 atomic percent carbon, and 3.9 to 15.4 atomic percent silicon. It may be appreciated that the alloys may not only include, but may also consist essentially of or consist of the above described constituents. Furthermore, even where the alloys consist of the above, it may be appreciated that some degree of impurities may be present in the alloy compositions, such as in the range of 0.01 to 1.0 atomic percent of impurities, including all values and increments therein at 0.01 atomic percent increments.

Accordingly, it may therefore be appreciated that iron may be present at 52.0, 52.1, 52.2, 52.3, 52.4, 52.5, 52.6, 52.7, 52.8, 52.9, 53.0, 53.1, 53.2, 53.3, 53.4, 53.5, 53.6, 53.7, 53.8, 53.9, 54.0, 54.1, 54.2, 54.3, 54.4, 54.5, 54.6, 54.7, 54.8, 54.9, 55.0, 55.1, 55.2, 55.3, 55.4, 55.5, 55.6, 55.7, 55.8, 55.9, 56.0, 56.1, 56.2, 56.3, 56.4, 56.5, 56.6, 56.7, 56.8, 56.9, 57.0, 57.1, 57.2, 57.3, 57.4, 57.5, 57.6, 57.7, 57.8, 57.9, 58.0, 58.1, 58.2, 58.3, 58.4, 58.5, 58.6, 58.7, 58.8, 58.9, 59.0, 59.1, 59.2, 59.3, 59.4, 59.5, 59.6, 59.7, 59.8, 59.9, 60.0, 60.1, 60.2, 60.3, 60.4, 60.5, 60.6, 60.7, 60.8, 60.9, 61.0, 61.1, 61.2, 61.3, 61.4, 61.5, 61.6, 61.7, 61.8, 61.9, 62.0, 62.1, 62.2, 62.3, 62.4, 62.5, 62.6, 62.7, 62.8, 62.9, 63.0, 63.1, 63.2, 63.3, 63.4, 63.5, 63.6, 63.7, 63.8, 63.9, 64.0, 64.1, 64.2, 64.3, 64.4, 64.5, 64.6, 64.7, 64.8, 64.9, 65.0, 65.1, 65.2, 65.3, 65.4, 65.5, 65.6, 65.7, 65.8, 65.9, 66.0, 66.1, 66.2, 66.3, 66.4, 66.5, 66.6, 66.7, 66.8, 66.9, 67.0, 67.1, 67.2, 67.3, 67.4, 67.5, 67.6, 67.7, 67.8, 67.9, 68.0 atomic percent. It may also be appreciated that nickel may be present at 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5, 20.6, 20.7, 20.8, 20.9, 21.0 atomic percent. Cobalt may be present at 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0 atomic percent. Boron may be present at 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0 atomic percent. Carbon may be present at 0.0, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0 atomic percent. Silicon may be present at 0.0, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0 atomic percent.

The alloys may also exhibit a critical cooling rate for metallic glass formation of about <100,000 K/s. Critical cooling rate may be understood as a rate of continuous cooling which may suppress and/or reduce transformations, which may be undesirable, such as crystallization. Accordingly, the alloys may be formed by melting and cooling the alloys at or below the critical cooling rate avoiding glass devitrification and forming a supersaturated matrix. The supersaturated matrix may then undergo spinodal decomposition forming spinodal microconstituents. Methods of forming the alloys (including melting and/or cooling the alloys) include those methods that may allow for the alloys to cool at a rate that is equal to or greater than the critical cooling rate, such as melt spinning. In addition, the alloy may be processed to yield a thin product from 1 μm to 2000 μm in thickness in the form of a powder particle, thin film, flake, ribbon, wire, or sheet. An example of an alloy forming technique may include melt spinning, jet casting, Taylor-Ulitovsky, melt-overflow, planar flow casting, and twin roll casting.

The alloy may exhibit a density in the range of 7 to 8 grams per cubic centimeter, including all values and increments therein, as measured by the Archimedes method, such as 7.1, 7.2, 7.3, 7.4, 7.5, 7.6, 7.7, 7.8, 7.9 8.0 grams per cubic centimeter. The alloys may also exhibit one or more onset crystallization temperature in the range of 400° C. to 585° C., including all values and increments therein in 1° C. increments, measured by DTA at 10° C./min. The alloy may exhibit one or more a peak crystallization temperatures in the range of about 400 to 595° C., including all values and increments therein in 1° C. increments, measured by DTA at 10° C./min. In addition, the alloys may exhibit one or more onset melting temperatures in the range of 1050° C. to 1100° C., including all values and increments therein in 1° C. increments, measured by DTA at 10° C./min and one or more peak melting temperature in the range of 1050° C. to 1125° C., including all values and increments therein in 1° C. increments. It can be appreciated that the onset temperatures occur before the respective peak temperatures and that multiple onset and peak crystallization and/or melting temperatures may be present.

The resulting microstructure of the alloys after being produced may therefore all include as a portion thereof a spinodal microconstituent which includes one or more crystalline phases uniformly dispersed at a length scale less than 50 nm. Reference to uniformly dispersed may be understood as noted above in that the spinodal microconstituent is formed via a phase separation that occurs within the sample material and not at discrete nucleation sites.

Such spinodal microstructure may also include all amorphous regions, isolated crystalline precipitates in a glass matrix, multiphase crystalline clusters growing into the glass matrix, completely crystalline areas with nanocrystalline crystallite from 10 to 100 nm, a three phase nanoscale microconstituent with about two relatively fine, i.e., less than 15 nm, including all values and increments in the range of 1 nm to 15 nm, crystalline phases intermixed in a glass matrix, as well as combinations thereof. In one example the resulting structure of the alloy may consist primarily of metallic glass. Reference to metallic glass may be understood as microstructures that may exhibit associations of structural units in the solid phase that may be randomly packed together. The level of refinement, or the size, of the structural units may be in the angstrom scale range (i.e. 5 Å to 100 Å).

In another example, the resulting structure of the alloys may consist of metallic glass and crystalline phases less than 500 nm in size, including all values and increments in the range of 10 nm to 500 nm in size. Furthermore, as noted above, the alloys may transform to yield at least a portion of its structure as a spinodal microconstituent which may consist of one or more crystalline phases at a length scale less than 50 nm in a glass matrix. In other words, the largest linear dimension of the semi-crystalline or crystalline phases may be in the range of 1 nm to 50 nm, including all values and increments therein.

The alloys may exhibit varying degrees of brittleness, and as measured by a bend test, i.e., bending of ribbons 180°, wherein the alloy samples could be bent on either side, on one side or could not bend without breaking. The alloy structure may exhibit a tensile elongation greater than 0.65%, including all values and increments in the range of 0.65% to 7.5% at 0.01 increments, such as 1 to 7.06%. In addition, the alloy may exhibit a yield strength greater than 0.1 GPa, including all values and increments in the range of 0.1 GPa to 2.2 GPa. The alloy may also exhibit an ultimate tensile strength of 0.1 GPa to 3.5 GPa, including all values and increments therein, a Young's Modulus of 55 GPa to 130 GPa, including all values and increments therein. The alloys herein are thus capable of providing one or more of the above referenced mechanical properties in combination.

The following examples are presented for purposes of illustration only and are not meant to limit the scope of the application. In addition, the examples may provide support for ranges within the specific points disclosed.

Sample Preparation

Using high purity elements (i.e., being 99% purity or greater), 15 g alloy feedstocks of the targeted alloys were weighed out according to the atomic ratio's provided in Table 1. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at tangential velocities which typically were either 16 or 10.5 m/s. The resulting ribbons that were produced had widths which were typically ~1.25 mm and thickness from 0.04 to 0.08 mm as shown in Table 2.

TABLE 1

Atomic Ratio's for Alloys

| | Fe | Ni | Co | B | C | Si |
|---|---|---|---|---|---|---|
| PC7E4A9 | 56.00 | 17.93 | 11.57 | 10.35 | 3.76 | 0.39 |
| PC7E4C3 | 54.00 | 16.72 | 10.78 | 13.20 | 4.80 | 0.50 |
| PC7E6H9 | 60.00 | 16.11 | 6.39 | 12.49 | 4.54 | 0.47 |
| PC7E6J1 | 52.00 | 20.11 | 10.39 | 12.49 | 4.54 | 0.47 |
| PC7E7 | 53.50 | 15.50 | 10.00 | 16.00 | 4.50 | 0.50 |

TABLE 2

Ribbon Thickness as a Function of Alloy and Wheel Speed

| Alloy | Wheel Speed (m/s) | Ribbon Thickness (mm) |
|---|---|---|
| PC7e4C3 | 16 | 0.04-0.05 |
| | 10.5 | 0.07-0.08 |
| PC7e7 | 16 | 0.04-0.05 |
| | 10.5 | 0.07-0.08 |
| PC7e4A9 | 16 | 0.04-0.05 |
| | 10.5 | 0.07-0.08 |
| PC7e6H9 | 16 | 0.04-0.05 |
| | 10.5 | 0.07-0.08 |
| PC7e6J1 | 16 | 0.04-0.05 |
| | 10.5 | 0.07-0.08 |

Density

The density of the alloys in ingot form was measured using the Archimedes method in a specially constructed balance allowing weighing in both air and distilled water. The density of the arc-melted 15 gram ingots for each alloy is tabulated in Table 3 and was found to vary from 7.73 g/cm$^3$ to 7.85 g/cm$^3$. Experimental results have revealed that the accuracy of this technique is +−0.01 g/cm$^3$.

TABLE 3

Density of Alloys

| Alloy | Density (g/cm$^3$) |
|---|---|
| PC7E4A9 | 7.85 |
| PC7E4C3 | 7.77 |
| PC7E6H9 | 7.77 |
| PC7E6J1 | 7.83 |
| PC7E7 | 7.73 |

As-Solidified Structure

Thermal analysis was done on the as-solidified ribbon structure on a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 4, the DSC data related to the glass to crystalline transformation is shown for the alloys that have been melt-spun at two different wheel tangential velocities at 16 m/s and 10.5 m/s. Note that the cooling rate increases at increasing wheel tangential velocities. In FIGS. 1 and 2, the corresponding DTA plots are shown for each sample melt-spun at 16 and 10.5 m/s. As can be seen, the majority of samples exhibit glass to crystalline transformations verifying that the as-spun state contains significant fractions of metallic glass. The PC7E4A9 alloy was found to exhibit reduced glass forming ability with only a small glass peak when processed at 16 m/s and no glass peak when processed at 10.5 m/s. The glass to crystalline transformation occurs in either one stage or two stages in the range of temperature from ~420 to ~480° C. and with enthalpies of transformation from ~−3 to ~−127 J/g.

TABLE 4

DSC Data for Glass To Crystalline Transformations

| | | Peak #1 | | | Peak #2 | | |
|---|---|---|---|---|---|---|---|
| Alloy | Glass | Onset (° C.) | Peak (° C.) | ΔH (-J/g) | Onset (° C.) | Peak (° C.) | ΔH (-J/g) |
| PC7E4A9w16 | Yes | 465 | 473 | 3.4 | | | |
| PC7E4A9w10.5 | No | | | | | | |
| PC7E4C3w16 | Yes | 439 | 449 | 13.0 | 475 | 480 | 24.6 |
| PC7E4C3w10.5 | Yes | 437 | 447 | 30.6 | 475 | 480 | 53.8 |
| PC7E6H9w16 | Yes | 422 | 435 | 38.7 | 474 | 479 | 62.3 |
| PC7E6H9w10.5 | Yes | 429 | 441 | 47.0 | 474 | 478 | 82.8 |
| PC7E6J1w16 | Yes | 421 | 432 | 35.4 | 465 | 469 | 63.0 |
| PC7E6J1w10.5 | Yes | 420 | 430 | 17.5 | 462 | 467 | 33.2 |
| PC7E7w16 | Yes | 466 | 469 | 40.6 | | | |
| PC7E7w10.5 | Yes | 468 | 473 | 127.2 | | | |

Overlapping peaks, peak 1 and peak 2 enthalpy combined

In Table 5, elevated temperature DTA results are shown indicating the melting behavior for the alloys shown in Table 1. As can be seen from the tabulated results in Table 4 and the melting peaks in FIGS. 1 and 2, melting occurs in 1 to 3 stages with initial melting (i.e. solidus) observed from ~1070° C. and with final melting up to ~1118° C.

TABLE 5

Differential Thermal Analysis Data for Melting Behavior

| Alloy | Peak #1 Onset (° C.) | Peak #1 Peak (° C.) | Peak #2 Onset (° C.) | Peak #2 Peak (° C.) | Peak #3 Onset (° C.) | Peak #3 Peak (° C.) |
|---|---|---|---|---|---|---|
| PC7E4A9 | 1079 | 1090 | 1084 | 1092 | 1080 | 1095 |
| PC7E4C3 | 1075 | 1083 | 1080 | 1088 | 1086 | 1094 |
| PC7E6H9 | 1085 | 1092 | 1090 | 1098 | | |
| PC7E6J1 | 1070 | 1078 | 1079 | 1085 | | |
| PC7E7 | 1073 | 1084 | ~1079 | 1091 | ~1112 | 1118 |

X-Ray Diffraction Analysis

The as-spun ribbons were cut into short segments and four to six pieces of ribbon were placed on an off-cut $SiO_2$ single crystal (zero-background holder). The ribbons were situated such that either the shiny side (free side) or the dull side (wheel side) were positioned facing up on the holder. A small amount of silicon powder was placed on the holder as well, and then pressed down so that the height of the silicon matched the height of the ribbon, which allows for matching any peak position errors in subsequent detailed phase analysis. X-ray diffraction scans were taken from 20 to 100 degrees two theta with a step size of 0.02 degrees and at a scanning rate of 2 degrees/minute. The X-ray tube settings were measured with a copper target at 40 kV and 44 mA. In FIGS. 3, 4, 5, 6, 7, 8, 9, 10, 11, and 12, X-ray diffraction scans are shown on both the free side (top curve) and wheel side (bottom curve) of the ribbons for the PC7E4A9 melt-spun at 16 m/s, PC7E4A9 melt-spun at 10.5 m/s, PC7E4C3 melt-spun at 16 m/s, PC7E4C3 melt-spun at 10.5 m/s, PC7E6H9 melt-spun at 16 m/s, PC7E6H9 melt-spun at 10.5 m/s, PC7E6J1 melt-spun at 16 m/s, PC7E6J1 melt-spun at 10.5 m/s, PC7E7 melt-spun at 16 m/s, and PC7E7 melt-spun at 10.5 m/s respectively. While the silicon added can dominate in the X-ray scans, it is clear that the fraction of glass and crystalline content and the phases which are formed are varying as a function of both wheel speed and through the cross section of the ribbon from the wheel side to the free side with some sample surfaces showing 100% glass and others showing 100% crystallinity. Note that due to conductive heat transfer the wheel side cools the quickest but depending on thickness the free side can cool faster than the center of the ribbon due to the fact that melt-spinning was done in a partial pressure of helium allowing for both radiative and conductive heat transfer on the free surface of the ribbon. At this time, the phases have not been identified in the X-ray diffraction scans but initial results seem to indicate one or more FCC phases are present.

TEM Analysis

Specimens for transmission electron microscopy (TEM) were produced from melt-spun ribbon by a combination of mechanical thinning and ion milling. The ribbons were mechanically thinned from their original thickness to approximately 10 microns using fine-grit sandpaper followed by polishing using 5 micron and 0.3 micron alumina powder on felt pads with water used as a lubricant in both cases. Ribbon sections of 3 mm were then cut using a razor blade and the resulting sections were mounted on copper support rings with two-part epoxy since the support rings provide structural integrity for handling. The specimens were then ion milled using a Gatan Precision Ion Polishing System (PIPS) operating at 4.5 kV. Incident angles were decreased from 9 degrees to 8 degrees and finally 7 degrees every ten minutes during the ion milling process. The resulting thin areas were examined using a JEOL 2010 TEM operating at 200 kV. For each alloy listed in Table 1, TEM micrographs were taken near the center of the ribbon thickness for samples melt-spun at both 16 m/s and 10 m/s. In FIGS. 13, 14, 15, 16, 17, 18, 19, 20, 21, and 22, TEM micrograph are shown in the central regions of the ribbons for the PC7E4A9 melt-spun at 16 m/s, PC7E4A9 melt-spun at 10.5 m/s, PC7E4C3 melt-spun at 16 m/s, PC7E4C3 melt-spun at 10.5 m/s, PC7E6H9 melt-spun at 16 m/s, PC7E6H9 melt-spun at 10.5 m/s, PC7E6J1 melt-spun at 16 m/s, PC7E6J1 melt-spun at 10.5 m/s, PC7E7 melt-spun at 16 m/s, and PC7E7 melt-spun at 10.5 m/s respectively. Additionally on the Figures, selected area electron diffraction patterns are shown corresponding to the figures for the specific areas noted. The TEM studies show a diversity of structure from 100% amorphous regions, isolated crystalline precipitates in a glass matrix, multiphase crystalline clusters growing into the glass matrix, completely crystalline areas with nanocrystalline crystallites from 10 to 100 nm and a unique three phase nano scale microconstituent with two very fine (i.e. <15 nm) crystalline phases intermixed in a glass matrix (see also case example #3).

Mechanical Property Testing

Mechanical property testing was done primarily through using qualitative 180° bend testing and tensile testing. The following sections will detail the technical approach and measured data.

180 Degree Bend Testing

Figure 23:
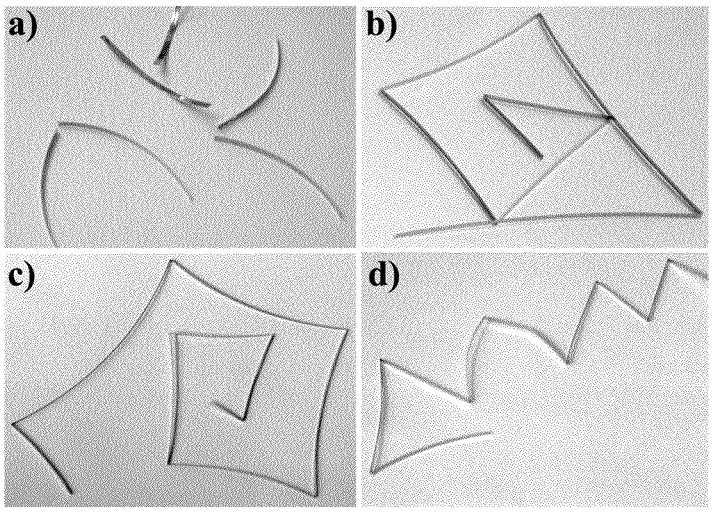
FIG. 23 illustrates typical example ribbons of ribbons which were bent 180° showing the 4 types of bending behavior; a) PC78E4A9 melt-spun at 16 m/s showing Type 1 Behavior, b) PC7E6H9 melt-spun at 10.5 m/s showing Type 2 Behavior, c) PC7E7 melt-spun at 10.5 m/s showing Type 3 Behavior, and d) PC7E7 melt-spun at 16 m/s and exhibiting Type 4 Behavior.

The ability of the ribbons to bend completely flat indicates a special condition whereby relatively high strain can be obtained but not measured by traditional bend testing. When the ribbons are folded completely around themselves, they experience relatively high strain which can be as high as 119.8% as derived from complex mechanics. In practice, the strain may be in the range of ~57% to ~97% strain in the tension side of the ribbon. During 180° bending (i.e. flat), four types of behavior were observed; Type 1 Behavior—not bendable without breaking, Type 2 Behavior—bendable on one side with wheel side out, Type 3 Behavior—bendable on one side with free side out, and Type 4 Behavior—bendable on both sides. In Table 6, a summary of the 180° bending results including the specific behavior type are shown for the studied alloys processed at both 16 and 10.5 m/s. In FIG. 23, optical pictures are shown of various ribbon samples after 180° bending representing examples of the 4 different types of bending behavior.

TABLE 6

Summary of Bend Test Results

| Alloy | Wheel Speed (m/s) | Bending Response | Behavior Type |
|---|---|---|---|
| PC7E4A9 | 16 | Not Bendable without breaking | Type 1 |
| PC7E4C3 | 16 | Bendable on both sides | Type 4 |
| PC7E6H9 | 16 | Bendable on both sides | Type 4 |
| PC7E6J1 | 16 | Bendable on both sides | Type 4 |
| PC7E7 | 16 | Bendable on both sides | Type 4 |
| PC7E4A9 | 10.5 | Not Bendable without breaking | Type 1 |
| PC7E4C3 | 10.5 | Not Bendable without breaking | Type 1 |
| PC7E6H9 | 10.5 | Bendable on one side with wheel side out | Type 2 |
| PC7E6J1 | 10.5 | Bendable on one side with wheel side out | Type 2 |
| PC7E7 | 10.5 | Bendable on one side with free side out | Type 3 |

Tensile Test Results

The mechanical properties of metallic ribbons were obtained at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length.

Before testing, the thickness and width of a ribbon were carefully measured for at least three times at different locations in the gauge length. The average values were then recorded as gauge thickness and width, and used as input parameters for subsequent stress and strain calculation. The initial gauge length for tensile testing was set at ~2.50 mm with the exact value determined after the ribbon was fixed, by accurately measuring the ribbon span between the front faces of the two gripping jaws. All tests were performed under displacement control, with a strain rate of ~0.001 $s^{-1}$.

In Table 7, a summary of the tensile test results including total elongation, yield strength, ultimate tensile strength, Young's Modulus, Modulus of Resilience, and Modulus of Toughness are shown for each alloy of Table 1 when melt-spun at both 16 and 10.5 m/s. Note that each distinct sample was measured in triplicate since occasional macrodefects arising from the melt-spinning process can lead to localized areas with reduced properties. The results shown in Table 7 have not been adjusted for machine compliance.

TABLE 7

Summary of Tensile Test Results (uncorrected)

| Sample | Total Elongation (%) | Yield Strength (GPa) | UTS (GPa) | Young's Modulus (GPa) |
|---|---|---|---|---|
| PC7E4C3 | 3.78 | 0.95 | 0.95 | 26.60 |
| at 10.5 m/s | 4.58 | 1.39 | 1.49 | 31.20 |
| | 3.35 | 1.40 | 1.40 | 28.60 |
| PC7E4C3 | 9.46 | 1.35 | 2.74 | 31.50 |
| at 16 m/s | 9.79 | 0.95 | 2.24 | 22.40 |
| | 7.54 | 0.69 | 1.79 | 30.00 |
| PC7E4A9 | 3.49 | 0.85 | 0.85 | 21.80 |
| at 10.5 m/s | 3.54 | 0.88 | 0.89 | 24.90 |
| | 2.79 | 0.53 | 0.53 | 19.90 |
| PC7E4A9 | 4.52 | 0.52 | 1.00 | 24.00 |
| at 16 m/s | 1.64 | 0.36 | 0.41 | 31.10 |
| | 2.87 | 0.53 | 0.78 | 24.50 |
| PC7E6H9 | 8.69 | 1.11 | 1.77 | 24.90 |
| at 10.5 m/s | 11.07 | 1.11 | 2.27 | 21.70 |
| | 11.52 | 1.23 | 1.95 | 17.88 |
| PC7E6H9 | 10.92 | 0.93 | 1.61 | 18.20 |
| at 16 m/s | 10.48 | 1.06 | 1.71 | 15.80 |
| | 7.39 | 0.65 | 1.36 | 20.20 |
| PC7E6J1 | 2.72 | 0.54 | 0.72 | 27.70 |
| at 10.5 m/s | 1.76 | 0.33 | 0.33 | 22.40 |
| | 3.52 | 0.11 | 1.26 | 29.80 |
| PC7E6J1 | 9.05 | 0.81 | 1.66 | 19.60 |
| at 16 m/s | 8.17 | 0.55 | 1.68 | 27.60 |
| | 10.86 | 0.87 | 1.58 | 14.80 |
| PC7E7 | 8.61 | 1.40 | 2.70 | 33.10 |
| at 10.5 m/s | 5.13 | 1.30 | 1.34 | 23.50 |
| | 7.20 | 1.07 | 1.83 | 27.80 |
| PC7E7 | 5.62 | 1.56 | 2.44 | 27.5 |
| at 16 m/s | 5.62 | 1.43 | 2.13 | 21.3 |
| | 6.83 | 1.39 | 2.57 | 22.4 |

For the tensile measurements shown in Table 7, the data can be corrected to adjust for machine compliance coefficient and deviations in cross sectional area from rectangular cross sections. The corrected data which represents the most accurate tensile results are shown in Table 8. As can be seen the tensile strength values are relatively high and vary from 0.36 to 2.77 GPa while the total elongation values are also very significant for reduced length scale microstructures and vary from 0.65 to 4.61%.

TABLE 8

Summary of Tensile Test Results (corrected)

| Sample | Total Elongation (%) | Yield Strength (GPa) | UTS (GPa) | Young's Modulus (GPa) |
|---|---|---|---|---|
| PC7E4C3 | 1.51 | 1.05 | 1.05 | 101.08 |
| at 10.5 m/s | 1.83 | 1.53 | 1.64 | 118.56 |
| | 1.34 | 1.54 | 1.54 | 108.68 |

TABLE 8-continued

Summary of Tensile Test Results (corrected)

| Sample | Total Elongation (%) | Yield Strength (GPa) | UTS (GPa) | Young's Modulus (GPa) |
|---|---|---|---|---|
| PC7E4C3 | 3.78 | 1.46 | 2.96 | 119.70 |
| at 16 m/s | 3.92 | 1.03 | 2.42 | 85.12 |
| | 3.02 | 0.75 | 1.93 | 114.00 |
| PC7E4A9 | 1.40 | 0.94 | 0.94 | 82.84 |
| at 10.5 m/s | 1.42 | 0.97 | 0.98 | 94.62 |
| | 1.12 | 0.58 | 0.58 | 75.62 |
| PC7E4A9 | 1.81 | 0.56 | 1.08 | 91.20 |
| at 16 m/s | 0.66 | 0.39 | 0.44 | 118.18 |
| | 1.15 | 0.57 | 0.84 | 93.10 |
| PC7E6H9 | 3.48 | 1.22 | 1.95 | 94.62 |
| at 10.5 m/s | 4.43 | 1.22 | 2.50 | 82.46 |
| | 4.61 | 1.35 | 2.15 | 67.64 |
| PC7E6H9 | 4.37 | 1.00 | 1.74 | 69.16 |
| at 16 m/s | 4.19 | 1.14 | 1.85 | 60.04 |
| | 2.96 | 0.70 | 1.47 | 76.76 |
| PC7E6J1 | 1.09 | 0.59 | 0.79 | 105.26 |
| at 10.5 m/s | 0.70 | 0.36 | 0.36 | 85.12 |
| | 1.41 | 0.12 | 1.39 | 113.24 |
| PC7E6J1 | 3.62 | 0.87 | 1.79 | 74.48 |
| at 16 m/s | 3.27 | 0.59 | 1.81 | 104.88 |
| | 4.34 | 0.94 | 1.71 | 56.24 |
| PC7E7 | 3.44 | 1.54 | 2.97 | 125.78 |
| at 10.5 m/s | 2.05 | 1.43 | 1.47 | 89.30 |
| | 2.88 | 1.18 | 2.01 | 105.64 |
| PC7E7 | 2.25 | 1.68 | 2.64 | 104.50 |
| at 16 m/s | 2.25 | 1.54 | 2.30 | 80.94 |
| | 2.73 | 1.50 | 2.78 | 85.12 |

Proposed Mechanism

The following mechanism for microstructural formation has been developed to qualify the current results including the measured high elongation and the four distinct types of bending behavior observed in the melt-spun alloys. Note that these models are developed to coordinate the results but in no way are construed to limit the features of specific details of potentially more complex interactions. Additionally, the mechanism of microstructural formation and specific structural features may be relevant to a wide variety of metallic glass chemistries made with different base metals such as nickel, cobalt, magnesium, titanium, molybdenum, rare earths, etc.

If nucleation is completely avoided during solidification, a metallic glass structure may be formed. The metallic glass structure at room temperature is known to deform upon the application of a tensile stress by a localized inhomogeneous mechanism called shear banding resulting in brittle failure. Current research shows, high elongation and high bending strains occur only in specific samples which have significant and measurable amounts of metallic glass present. However, the presence of metallic glass alone is not expected nor believed to be the source of high elongation. Based on current results, it is believed that crystalline phase formation during solidification may occur in two distinct modes, Glass devitrification and Spinodal decomposition. Glass Devitrification may be understood to occur through nucleation and growth resulting from a high driving force in the supercooled melt which leads to a high nucleation frequency, limited time for growth and the achievement of nanoscale phases. Depending on the specific cooling rate, the devitrification transformation can occur completely (for Example see FIG. 14) or partially through isolated precipitation (for example see FIG. 18) or through a coupled eutectoid growth mode (for example see FIG. 16).

Figure 24:
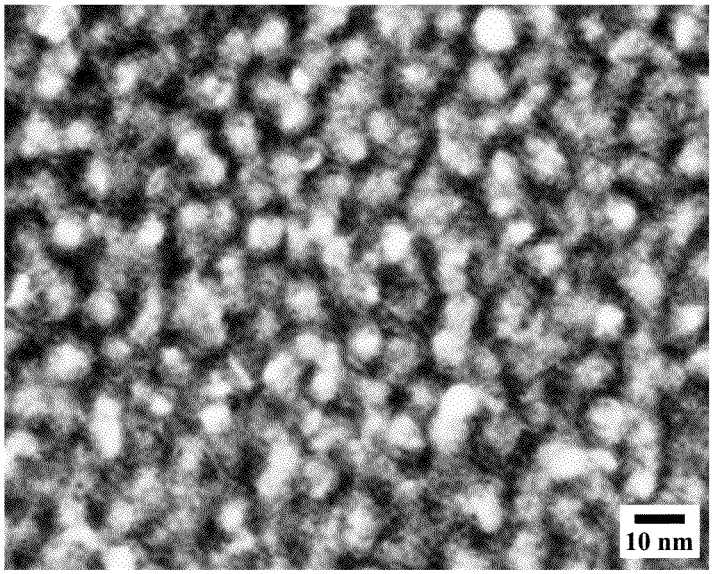
FIG. 24 illustrates an example of a TEM micrograph of the free surface of PC7E7 alloy which has been melt-spun at 10.5 m/s.

For the studied alloys, it is believed that examples of spinodal decomposition in various forms were shown including microconstituent bands (for example see FIG. 21A), partial decomposition (for example see FIG. 22C), and full decomposition (for example see FIG. 22A). An additional close-up of the microstructure shown in FIG. 22A is shown in FIG. 24. Notice the uniform and periodic distribution of the crystalline phases in the amorphous matrix.

In Table 6, for the alloy studied, the 180° bend tests were correlated and, as stated earlier, revealed 4 distinct types of behavior which were; Type 1 Behavior: Not bendable flat in either direction, Type 2 Behavior: Bendable flat in one direction with wheel side out, Type 3 Behavior: Bendable flat in one direction with free side out, and Type 4 Behavior: Bendable flat in both directions. The bending behavior illustrates material response over a fairly large area of bending and along the length of the ribbon since the bending response generally occurs along the entire length of the ribbon with the exception of isolated spots which, in most cases, can be attributed to macrodefects arising from the melt-spinning process. Note that during 180° bending the outside of the ribbon is placed into tension while the inside of the ribbon is placed into compression. While metallic glasses and other brittle structures may perform well in compression, in tension where shear bands (i.e., in situ tensile deformations) and cracks can propagate, metallic glasses may fail in a brittle manner. Thus, the different bending results may indicate differences in structure between the free, center, and wheel sides of the ribbons. The X-ray results shown in FIG. 3 through 12 clearly show the differences in structure in the free and wheel sides. As a function of chemistry, the TEM results in the center regions shown in FIGS. 13 through 22 show differences in structure from complete amorphous to fully or partially transformed through glass devitrification or the competing spinodal decomposition. Tensile testing which averages the entire volume over the gauge length also shows differences in material response. Thus, a picture is emerging of the influence of structure and mechanical response based on the existing SEM, TEM, X-ray, bend testing, and tensile testing. Note that the TEM studies in FIGS. 21 and 22 of identical samples (i.e., either PC7E7 melt-spun at 16 or 10.5 m/s), illustrate the localized differences and sensitivities in structural formation as a function of localized cooling conditions. Thus, the interpretation of TEM results can be difficult since such a small localized area is imaged.

Elongation of >0.65% is expected to be achieved through the interaction of the shear bands formed in the glass matrix with various crystalline features. While all crystalline features may be expected to provide some pinning or interaction with the domain walls based on the entirety of the results, it is believed that the most effective pinning/blunting, and shearing is occurring from the spinodal microconstituent regions. Thus, the following models are proposed to explain observed behavior. Note that the cooling rate at the wheel surface is the fastest due to conductive heat transfer to the copper wheel, followed by the free surface due to conductive/radiative heat transfer to the helium gas, and then followed by the center of the ribbon which is limited by thermal conductivity to the outside surfaces.

Type 1 Behavior Model

Figure 25:
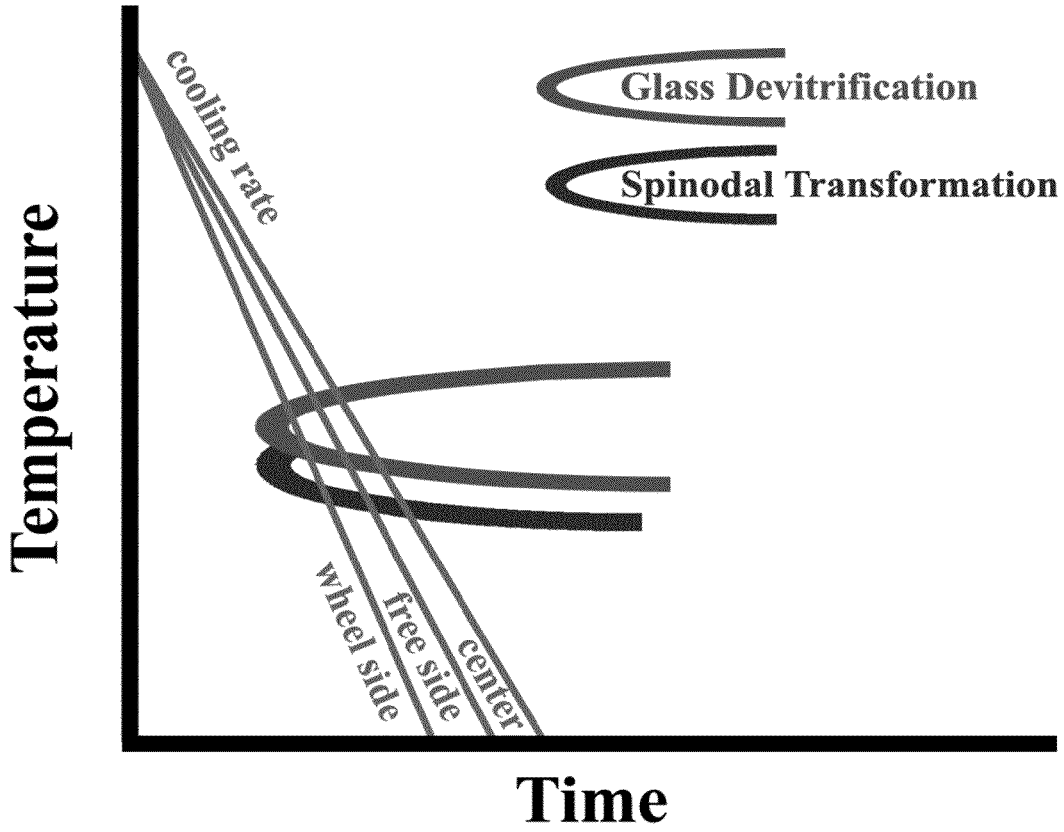
FIG. 25 illustrates an example of a Model CCT diagram showing Type 1 deformation behavior.

In FIG. 25, a model continuous cooling transformation (CCT) diagram is shown to illustrate the materials response in Type 1 Behavior. As shown, the wheel side, free side, and center regions cool slow enough so that the nose of the glass devitrification curve may be missed. Thus, crystalline phases are formed through conventional nucleation and growth. Note if high undercooling is achieved before nucleation is initiated, nanocrystalline grain sizes may be achieved. Once crystallization is complete there is not supersaturation of the starting chemistry, so no spinodal decomposition phases can form. Thus, the material response may be expected to be brittle and not bendable in a 180° test.

Type 2 Behavior Model

Figure 26:
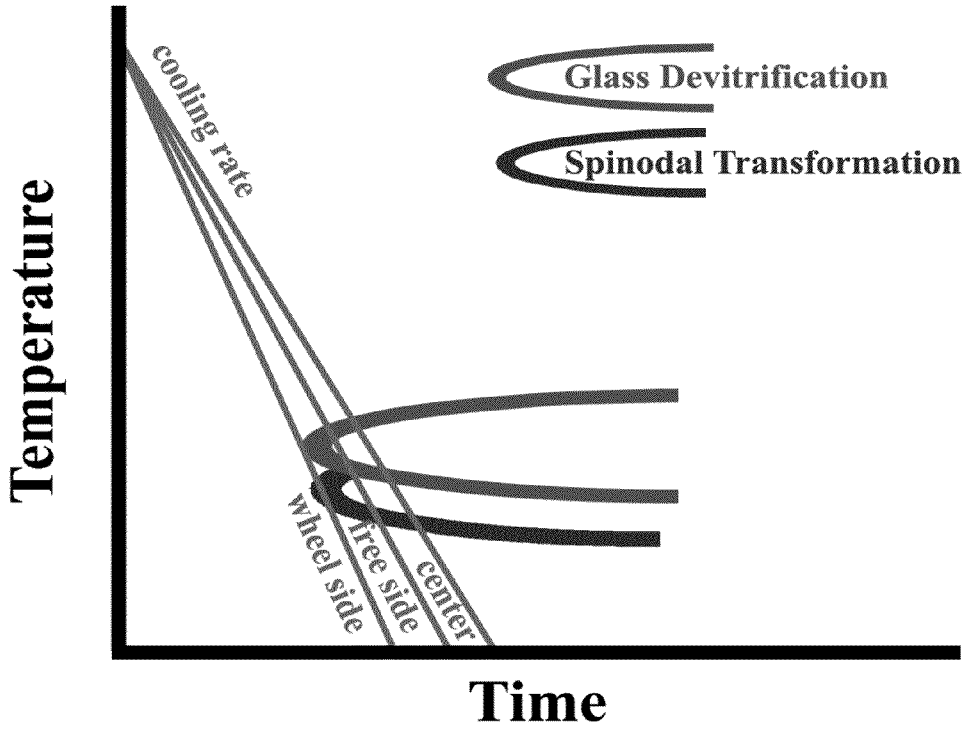
FIG. 26 illustrates an example of a Model CCT diagram showing Type 2 deformation behavior.

In FIG. 26, a model continuous cooling transformation (CCT) diagram is shown to illustrate the materials response in Type 2 Behavior. As shown, the wheel side misses the glass devitrification transformation but cools through the spinodal transformation. The microstructure thus forms the spinodal decomposition microconstituent with a uniform and relatively fine (i.e., <15 μm) distribution of crystalline phases in an amorphous matrix. The material response on the wheel side may be expected to exhibit high plasticity and the ability to bend completely flat when the wheel side is out (i.e. in tension). The free side and center of the ribbon are found to cool and miss the glass formation region and form a completely crystalline structure which may be nanoscale depending on total undercooling achieved prior to nucleation. Since supersaturation may be lost after crystallization, the spinodal decomposition reaction does not occur and the expected material response is brittle. Thus, when the ribbon is bent with the free side out (i.e. in tension), the material is expected to break and exhibit a brittle response.

Type 3 Behavior Model

Figure 27:
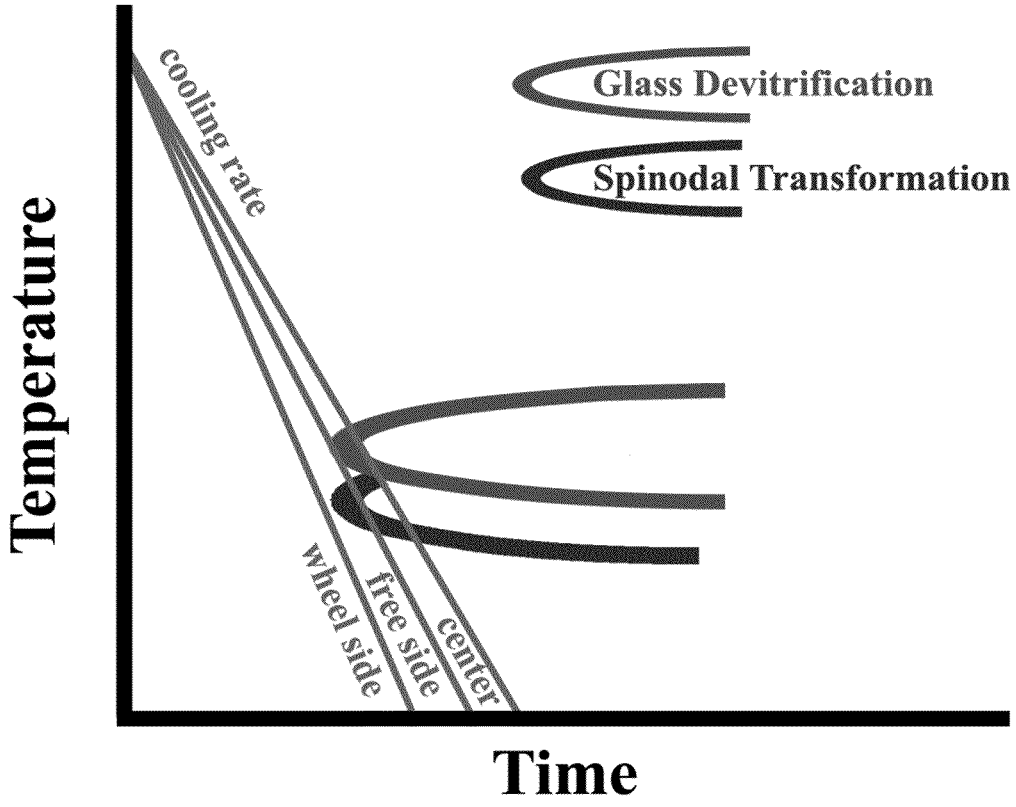
FIG. 27 illustrates an example of a Model CCT diagram showing Type 3 deformation behavior.

In FIG. 27, a model continuous cooling transformation (CCT) diagram is shown to illustrate the materials response in Type 3 Behavior. As indicated the wheel side cools and is found to miss both the start (i.e. nose) of both the glass devitrification and spinodal decomposition curves. The structure is found to be metallic glass only. The expected material response with the wheel side out (i.e. in tension) is brittle with no ability to bend flat. Note that subsequent annealing may allow spinodal decomposition to occur if the spinodal decomposition occurs at lower temperatures as the initial glass nucleation as shown in the Figure allowing the potential for enhanced improvements in ductility and bendability through annealing. With respect to the free side, as shown it cools and misses the nose of the glass devitrification curve and a supersaturated condition is retained. It then cools through the spinodal decomposition reaction and forms the spinodal decomposition microconstituent with multiple nanoscale phases in a glass matrix. The expected material response is high plasticity with the ability to bend 180° (i.e. flat) with the free side out (i.e. in tension). With respect to the center region as shown on the Figure, it cools and misses the glass formation region and goes through a complete devitrification transformation. Since supersaturation is lost, the spinodal reaction does not occur and the expected response is brittleness. Note that this the cooling rate achieved in the center region is actually a gradient representing significant width, thus a variance in structures could be achievable in the center of the ribbon from complete devitrification, partial spinodal decomposition, or complete spinodal decomposition. Note also, this explains the variations in structure observed in the center regions of the PC7E sample melt-spun at 10.5 m/s (see FIG. 22).

Type 4 Behavior Model

Figure 28:
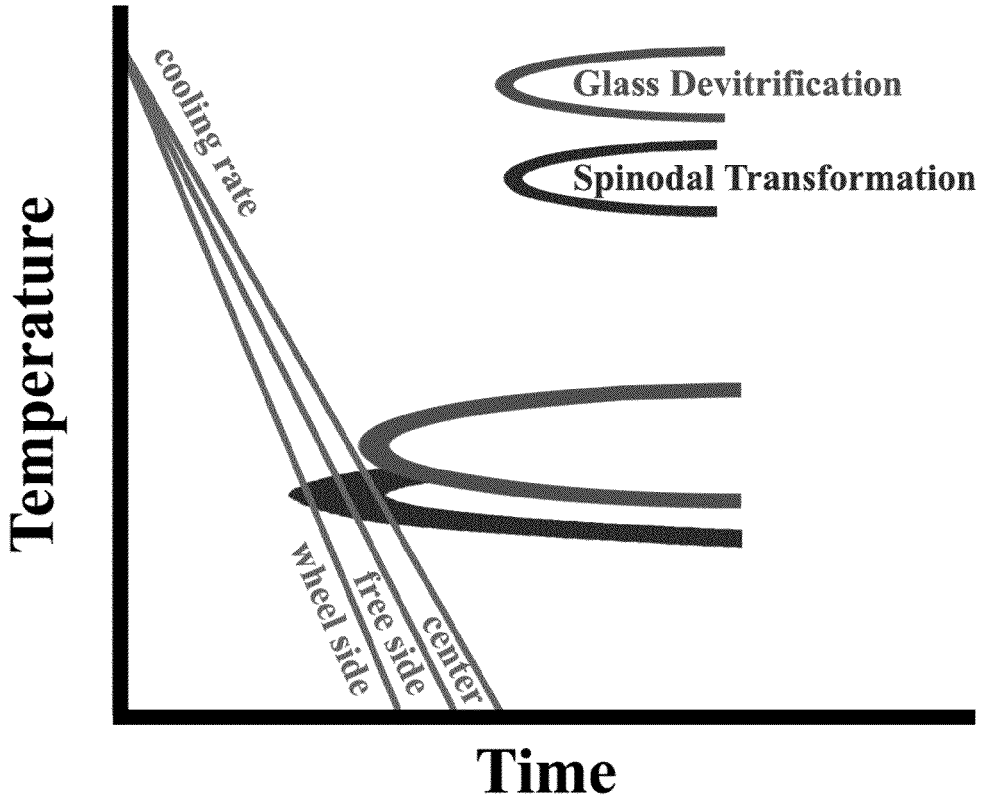
FIG. 28 illustrates an example of a Model CCT diagram showing Type 4 deformation behavior.

In FIG. 28, a model continuous cooling transformation (CCT) diagram is shown to illustrate the materials response in Type 4 Behavior. As shown the wheel side, free side, and the center region cools and misses the nose of the glass devitrification transformation. Then the wheel side, free side, and center regions cool through the spinodal decomposition curves forming the favorable spinodal microconstituent consisting of nanoscale multiple crystalline phases interdispersed in a glass matrix. Note that alternately, the center region which cools the slowest could partially devitrify and form a mixed structure. When the resulting ribbon is bent 180° with either the free side out (i.e. in tension) or the wheel side out (i.e. in tension), the expected material response is high plasticity and the ability to be folded flat without breaking.

CASE EXAMPLES

Case Example #1

Figure 29:
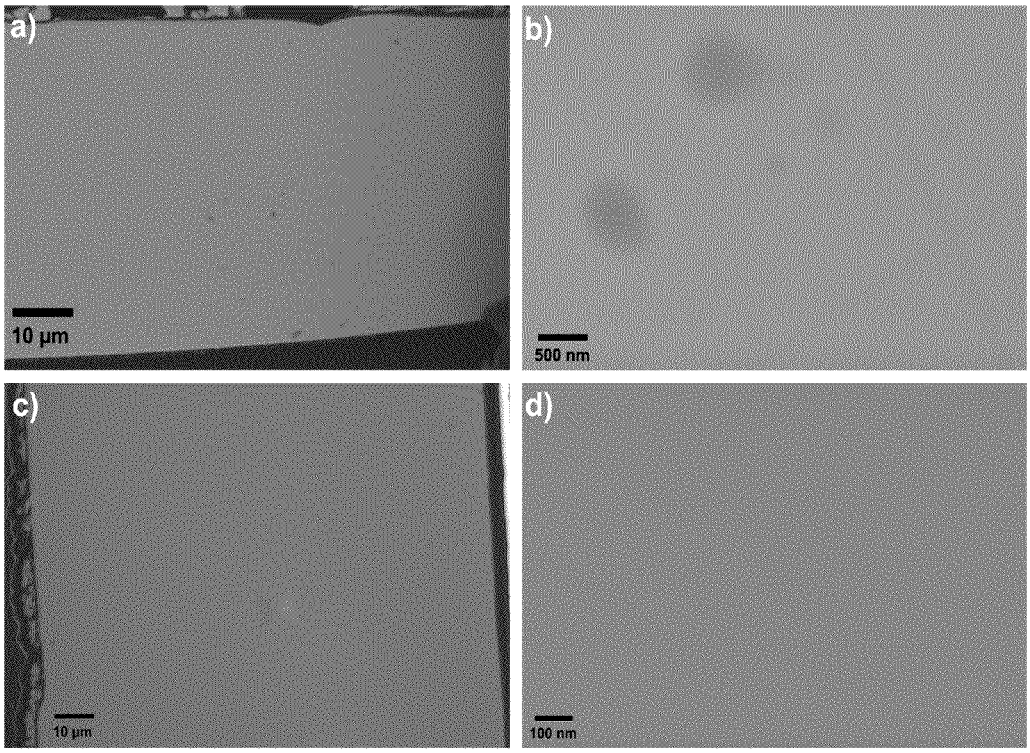
FIG. 29 illustrates examples of SEM backscattered electron micrographs of the PC7E4C3 ribbon; a) low magnification showing the entire ribbon cross section at 16 m/s, b) high magnification of the ribbon structure at 16 m/s, note the presence of scratches and voids, c) low magnification showing the entire ribbon cross section at 10.5 m/s, note the presence of a Vickers hardness indentation, d) high magnification of the ribbon structure at 10 m/s.
Figure 30:
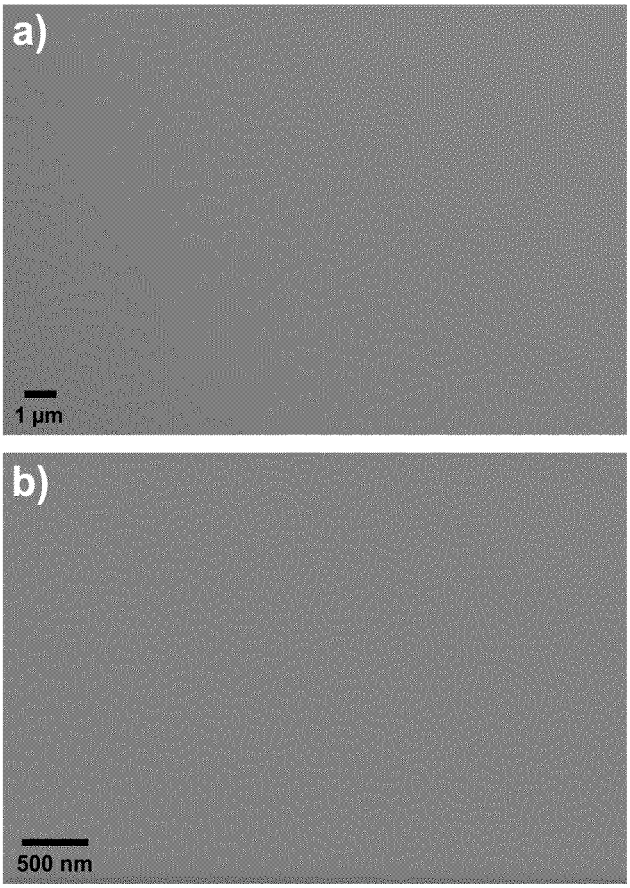
FIG. 30 illustrates an example of an SEM backscattered electron micrograph of the PC7E4C3 ribbon melt-spun at 16 m/s and then annealed at 1000° C. for 1 hour; a) medium magnification of the ribbon structure, b) high magnification of the ribbon structure.

Using high purity elements, fifteen gram charges of the PC7E4C3 chemistry were weighed out according to the atomic ratio's in Table 1. The mixture of elements was placed onto a copper hearth and arc-melted into ingots using ultrahigh purity argon as a cover gas. After mixing, the resulting ingots were cast into a figure shape appropriate for melt-spinning. The cast fingers of PC7E4C3 were then placed into a quartz crucible with a hole diameter nominally at 0.81 mm. The ingots were heated up by RF induction and then ejected onto a rapidly moving 245 mm copper wheel traveling at wheel tangential velocities of 16 and 10.5 m/s. To further examine the ribbon structure, scanning electron microscopy (SEM) was done on selected PC7E4C3 ribbon samples. Melt spun ribbons were mounted in a standard metallographic mount with several ribbons held using a metallography binder clip. The binder clip containing the ribbons was set into a mold and an epoxy is poured in and allowed to harden. The resulting metallographic mount was ground and polished using appropriate media following standard metallographic practices. The structure of the samples was observed using a Zeiss EVO-60 scanning electron microscope with an electron beam energy of 17.5 kV, a filament current of 2.4 A, a spot size setting of 800. As shown in FIG. 29, no microstructural features could be found other than isolated points of porosity. This clearly indicates the extremely fine scale of the microstructure which could not be resolved due to the resolution limits inherent with backscattered electron detection. Samples of ribbon were then annealed at 1000° C. for 1 hour to attempt to coarsen the unresolved structure. As shown in FIG. 30, the microstructure still cannot be resolved, which may indicate a relatively high degree of microstructural stability.

Case Example #2

Figure 31:
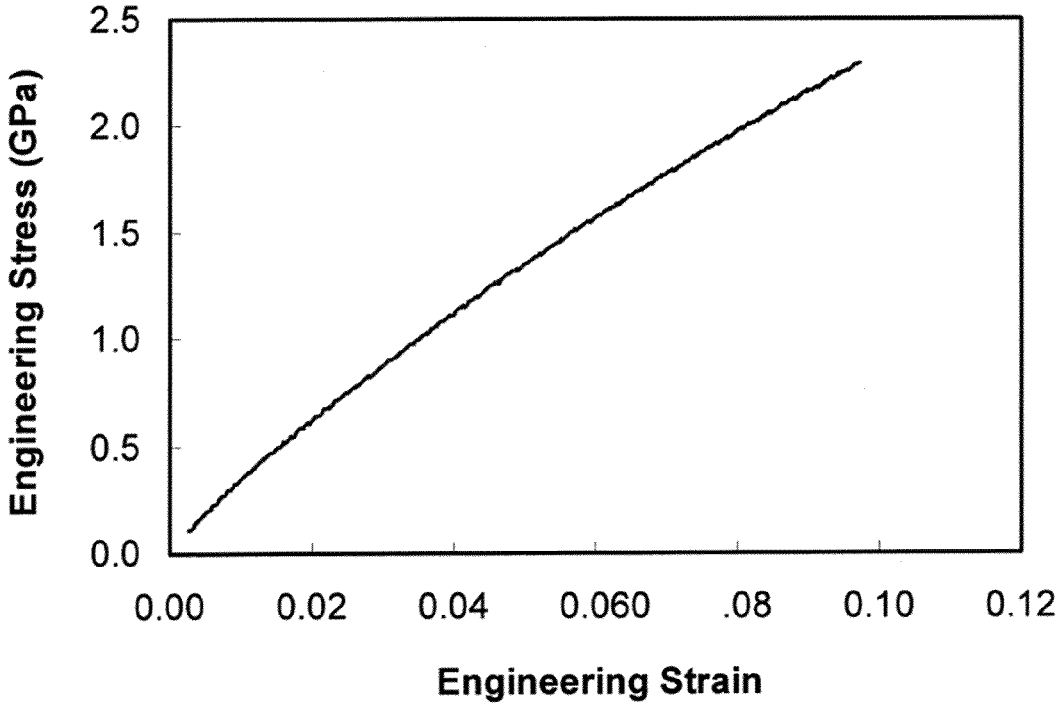
FIG. 31 illustrates an example of a stress strain curve for the PC7E7 alloy melt-spun at 16 m/s.
Figure 32:
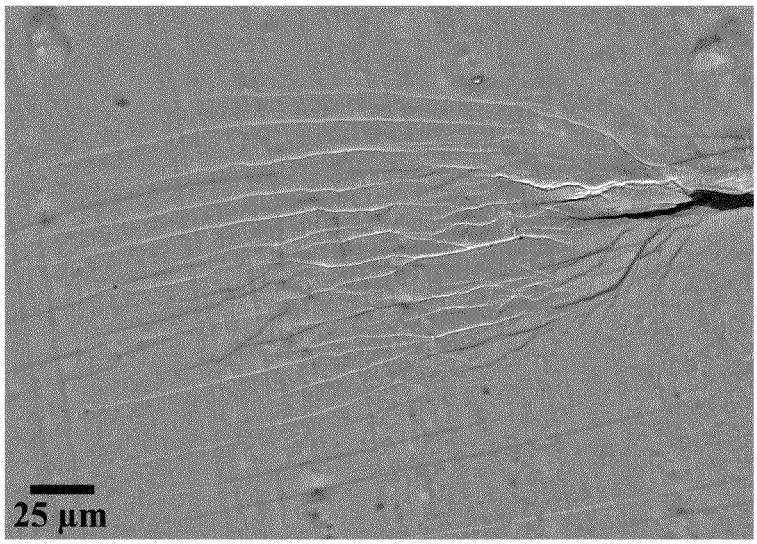
FIG. 32 illustrates an example of a SEM secondary electron image of the PC7E7 alloy melt-spun at 16 m/s and then tensile tested. Note the presence of the crack on the right hand side of the picture (black) and the presence of multiple shear bands indicating a large plastic zone in front of the crack tip.

Using high purity elements, a fifteen gram charge of the PC7E7 alloy was weighed out according to the atomic ratio's in Table 1. The mixture of elements was placed onto a copper hearth and arc-melted into an ingot using ultrahigh purity argon as a cover gas. After mixing, the resulting ingot was cast into a finger shape appropriate for melt-spinning. The cast fingers of PC7E7 were then placed into a quartz crucible with a hole diameter nominally at 0.81 mm. The ingots were heated up by RF induction and then ejected onto a rapidly moving 245 mm copper wheel traveling at a wheel tangential velocities of 16 m/s. The ribbon was cut into pieces and then tested in tension and the resulting tensile test stress/strain data from one test is shown in FIG. 31. The measured tensile strength was found to be 2.57 GPa with a total elongation of 9.71%. In FIG. 32, a SEM backscattered electron micrograph is shown of another piece of PC7E7 ribbon which was tensile tested using a large gage length of 23 mm. Note in the Figure, the presence of the crack on the right hand side of the picture (black) and the presence of multiple shear bands indicating a large plastic zone in front of the crack tip. The ability to blunt the crack tip in tension is believed to be a new feature in a sample which is primarily metallic glass. Note that the shear bands themselves in the region in front of the crack tip are changing direction and in some cases splitting indicating specific dynamic interactions between specific crystalline microstructural features and the moving shear bands. It is believed that these specific points of interaction may be arising from the specific spinodal microconstituent, which TEM studies indicate as forming in the alloy.

Case Example #3

Figure 33:
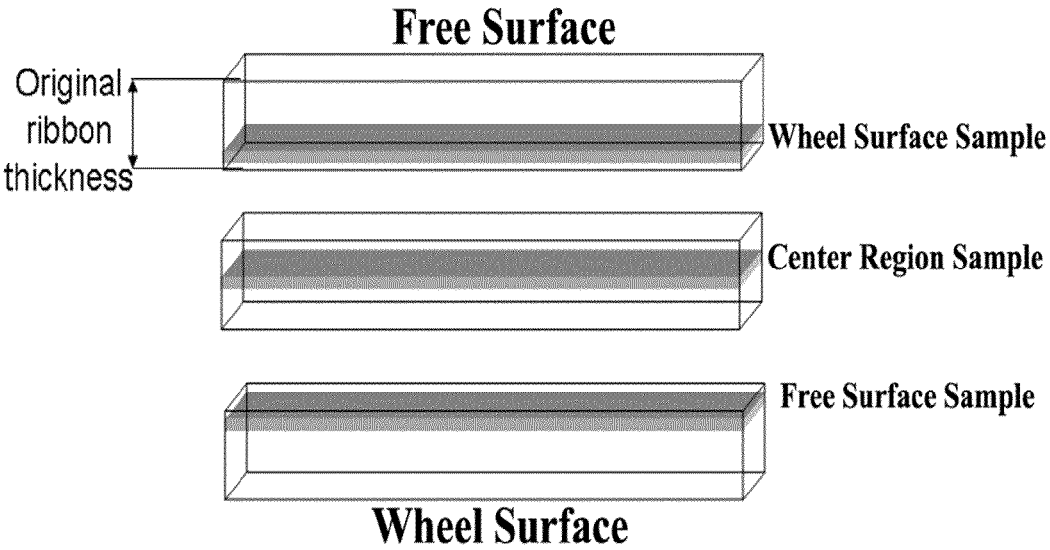
FIG. 33 illustrates an example of a schematic diagram showing the sample areas from which TEM samples were made for the PC7E7 alloy.
Figure 34:
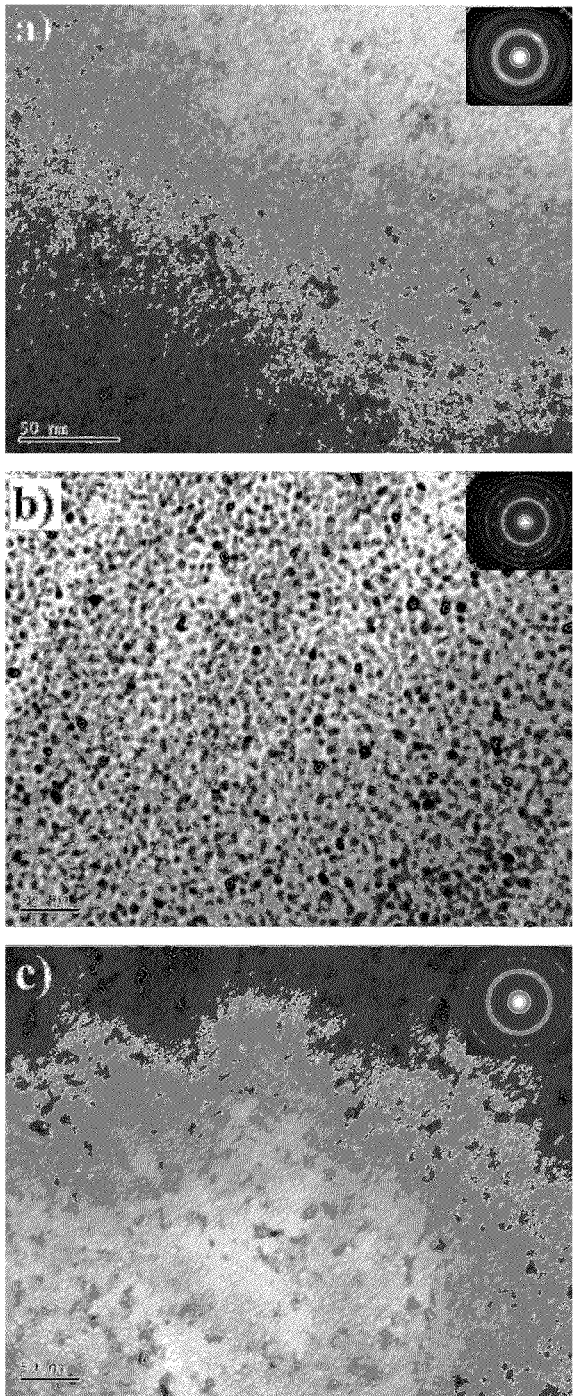
FIG. 34 illustrates an example of a TEM micrograph of PC7E7 which was melt-spun at 10.5 m/s; a) Wheel side of ribbon, b) Free side of ribbon, and c) Center of ribbon.

Using high purity elements, a fifteen gram charge of the PC7E7 alloy was weighed out according to the atomic ratio's in Table 1. The mixture of elements was placed onto a copper hearth and arc-melted into an ingot using ultrahigh purity argon as a cover gas. After mixing, the resulting ingot was cast into a finger shape appropriate for melt-spinning. The cast fingers of PC7E7 were then placed into a quartz crucible with a hole diameter nominally at 0.81 mm. The ingots were heated up by RF induction and then ejected onto a rapidly moving 245 mm copper wheel traveling at a wheel tangential velocities of 10.5 m/s. A piece of typical ribbon was then selected for TEM and was cut into three consecutive short segments. For each segment, the ribbons were mechanically thinned from their original thickness to approximately 10 microns using fine-grit sandpaper followed by polishing using 5 micron and 0.3 micron alumina powder on felt pads with water as a lubricant. The thinning of the three samples is shown in FIG. 33 and was done to expose the wheel surface (i.e. 5 μm from the edge), the center region of the ribbon, and the free surface (i.e. 5 μm from the edge). Ribbon sections of 3 mm were then cut using a razor blade and mounted on copper support rings with two-part epoxy since the support rings provide structural integrity for handling. The specimens were then ion milled using a Gatan Precision Ion Polishing System (PIPS) operating at 4.5 kV. Incident angles were decreased from 9 degrees to 8 degrees and finally 7 degrees every ten minutes. The resulting thin areas were examined using a JEOL 2010 TEM operating at 200 kV. In FIG. 34, TEM micrographs of PC7E7 which was melt-spun at 10.5 m/s are shown of the wheel side, free side, and center of the ribbon. As shown, the wheel side which cools the quickest is almost completely a glass with a small fraction of very fine clusters which appear to be not fully crystalline but of a semicrystalline nature. That is while the presence of the clusters can be seen in the micrograph and while they have a difference in chemistry, well defined Bragg diffractions spots are not seen in the selected area diffraction pattern indicating that the initial clusters are not fully crystalline but only partially crystalline. Note that this is expected during the early stages of a spinodal decomposition whereby further perturbations in chemistry in later stages will lead to crystalline clusters and distinct crystalline phases. The free side of the ribbon consists entirely of a nanoscale (<10 nm) crystalline phases arranged in a periodic fashion in an amorphous matrix consistent with a spinodal decomposition product (i.e. spinodal microconstituent). The center of the ribbon is found to consist of primarily amorphous regions with specific areas of spinodal microconstituent, which may indicate that the spinodal decomposition transformation is incomplete in this region.

Case Example #4

Figure 35:
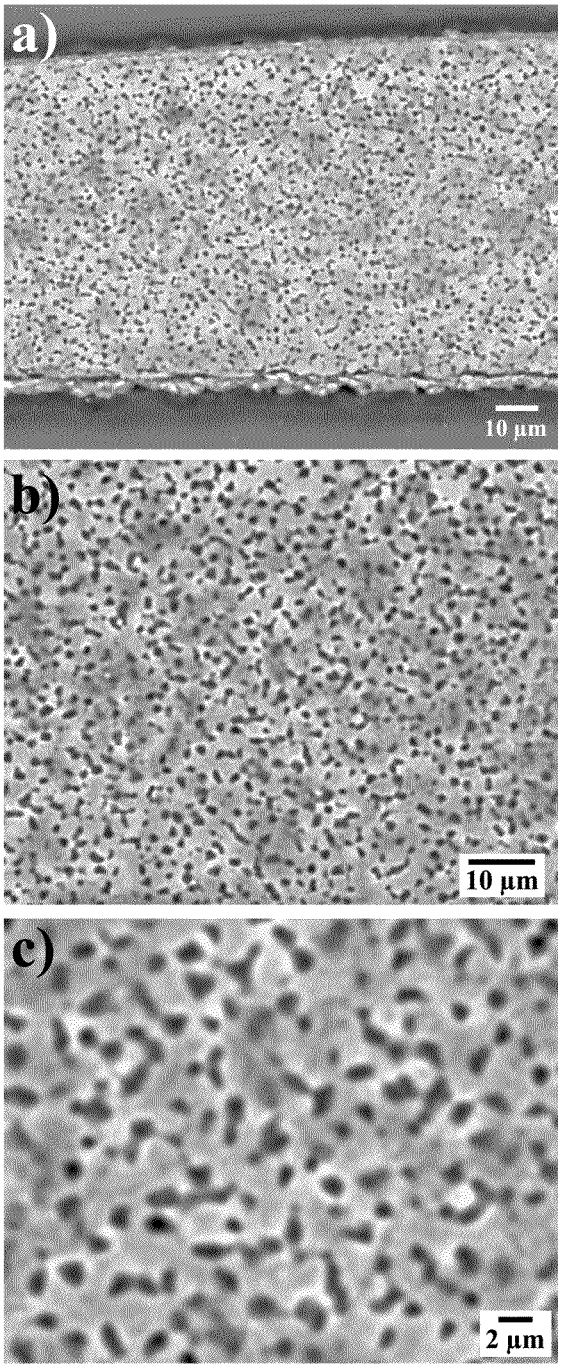
FIG. 35 illustrates an example of PC7E7 ribbon structures which have been melt-spun at 10.5 m/s and then etched; a) Low magnification, b) Medium magnification, and c) High magnification.

Using high purity elements, a fifteen gram charge of the PC7E7 alloy was weighed out according to the atomic ratio's in Table 1. The mixture of elements was placed onto a copper hearth and arc-melted into an ingot using ultrahigh purity argon as a cover gas. After mixing, the resulting ingot was cast into a finger shape appropriate for melt-spinning. The cast fingers of PC7E7 were then placed into a quartz crucible with a hole diameter nominally at 0.81 mm. The ingots were heated up by RF induction and then ejected onto a rapidly moving 245 mm copper wheel traveling at a wheel tangential velocity of 10.5 m/s. Sample of ribbon were then etched with a 2% bromine water solution. The structure of the etched sample was observed using an EVO-60 scanning electron microscope manufactured by Carl Zeiss SMT Inc. Typical operating conditions were electron beam energy of 17.5 kV, filament current of 2.4 A, and spot size setting of 800. In FIG. 35, SEM backscattered electron micrographs are shown for the etched PC7E7 sample at 10.5 m/s. It is not known the exact nature of the resulting etching interaction with the resulting structure. It is probable that the aggressive etchant primarily reacted with crystalline regions or crystalline regions containing the spinodal microconstituent (i.e. spinodal formed crystalline phases in a glass matrix). Thus, the etched structure may reveal the distribution of crystalline regions/microconstituent which may be interacting with dynamic shear bands in tensile testing.

Case Example #5

Using high purity elements, 15 g alloy feedstocks of the targeted alloys were weighed out according to the atomic ratio's provided in Table 9. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at tangential velocities of 10.5 m/s. Bending testing (180° of the as-spun ribbon samples was done on each sample and the results were correlated in Table 10. As shown, depending on the alloy when processed on the particular conditions listed, the bending response was found to vary, with four types of behavior observed; Type 1 Behavior—not bendable without breaking, Type 2 Behavior—bendable on one side with wheel side out, Type 3 Behavior—bendable on one side with free side out, and Type 4 Behavior—bendable on both sides. In Table 11, a summary of the tensile test results including total elongation, yield strength, ultimate tensile strength, Young's Modulus, Modulus of Resilience, and Modulus of Toughness are shown for each alloy of Table 8 when melt-spun at 10.5 m/s. Note that each distinct sample was measured in triplicate since occasional macrodefects arising from the melt-spinning process can lead to localized stresses reducing properties. The results shown in Table 11 have not been adjusted for machine compliance.

TABLE 9

Atomic Ratio's for Alloys

| Alloy | Fe | B | C | Si | Ni | Co |
|---|---|---|---|---|---|---|
| PC7E8S1A1 | 67.54 | 12.49 | 0.00 | 0.47 | 16.50 | 3.00 |
| PC7E8S1A2 | 66.04 | 12.49 | 1.50 | 0.47 | 16.50 | 3.00 |
| PC7E8S1A3 | 64.54 | 12.49 | 3.00 | 0.47 | 16.50 | 3.00 |
| PC7E8S1A4 | 63.00 | 12.49 | 4.54 | 0.47 | 16.50 | 3.00 |
| PC7E8S1A5 | 65.54 | 14.49 | 0.00 | 0.47 | 16.50 | 3.00 |
| PC7E8S1A6 | 64.04 | 14.49 | 1.50 | 0.47 | 16.50 | 3.00 |
| PC7E8S1A7 | 62.54 | 14.49 | 3.00 | 0.47 | 16.50 | 3.00 |
| PC7E8S1A8 | 61.00 | 14.49 | 4.54 | 0.47 | 16.50 | 3.00 |
| PC7E8S1A9 | 63.54 | 16.49 | 0.00 | 0.47 | 16.50 | 3.00 |
| PC7E8S1A10 | 62.04 | 16.49 | 1.50 | 0.47 | 16.50 | 3.00 |
| PC7E8S1A11 | 60.54 | 16.49 | 3.00 | 0.47 | 16.50 | 3.00 |
| PC7E8S1A12 | 59.00 | 16.49 | 4.54 | 0.47 | 16.50 | 3.00 |
| PC7E8S1A13 | 61.54 | 18.49 | 0.00 | 0.47 | 16.50 | 3.00 |
| PC7E8S1A14 | 60.04 | 18.49 | 1.50 | 0.47 | 16.50 | 3.00 |
| PC7E8S1A15 | 58.54 | 18.49 | 3.00 | 0.47 | 16.50 | 3.00 |
| PC7E8S1A16 | 57.00 | 18.49 | 4.54 | 0.47 | 16.50 | 3.00 |
| PC7E8S8A1 | 63.30 | 12.55 | 4.56 | 0.00 | 16.58 | 3.01 |
| PC7E8S8A2 | 63.00 | 12.49 | 4.54 | 0.47 | 16.50 | 3.00 |
| PC7E8S8A3 | 62.69 | 12.43 | 4.52 | 0.97 | 16.42 | 2.99 |
| PC7E8S8A4 | 62.37 | 12.37 | 4.49 | 1.47 | 16.34 | 2.97 |
| PC7E8S8A5 | 62.06 | 12.30 | 4.47 | 1.96 | 16.25 | 2.96 |
| PC7E8S8A6 | 61.74 | 12.24 | 4.45 | 2.46 | 16.17 | 2.94 |
| PC7E8S8A7 | 61.43 | 12.18 | 4.43 | 2.96 | 16.09 | 2.93 |
| PC7E8S8A8 | 61.11 | 12.12 | 4.40 | 3.46 | 16.01 | 2.91 |

TABLE 10

Ribbon Thickness, Bending Response and Behavior Type

| Alloy | Wheel Speed (m/s) | Ribbon Thickness (mm) | Bending Response | Behavior Type |
|---|---|---|---|---|
| PC7E8S1A1 | 10.5 | 0.07 to 0.08 | Not bendable without breaking | Type 1 |
| PC7E8S1A2 | 10.5 | 0.07 to 0.08 | Not bendable without breaking | Type 1 |
| PC7E8S1A3 | 10.5 | 0.07 to 0.08 | Bendable on one side with wheel side out | Type 2 |
| PC7E8S1A4 | 10.5 | 0.07 to 0.08 | Not bendable without breaking | Type 1 |
| PC7E8S1A5 | 10.5 | 0.07 to 0.08 | Not bendable without breaking | Type 1 |
| PC7E8S1A6 | 10.5 | 0.07 to 0.08 | Not bendable without breaking | Type 1 |
| PC7E8S1A7 | 10.5 | 0.07 to 0.08 | Bendable on one side with wheel side out | Type 2 |
| PC7E8S1A8 | 10.5 | 0.07 to 0.08 | Not bendable without breaking | Type 1 |
| PC7E8S1A9 | 10.5 | 0.07 to 0.08 | Bendable on both sides | Type 4 |
| PC7E8S1A10 | 10.5 | 0.07 to 0.08 | Bendable on both sides | Type 4 |
| PC7E8S1A11 | 10.5 | 0.07 to 0.08 | Not bendable without breaking | Type 1 |
| PC7E8S1A12 | 10.5 | 0.07 to 0.08 | Not bendable without breaking | Type 1 |
| PC7E8S1A13 | 10.5 | 0.07 to 0.08 | Bendable on both sides | Type 4 |
| PC7E8S1A14 | 10.5 | 0.07 to 0.08 | Bendable on one side with free side out | Type 3 |
| PC7E8S1A15 | 10.5 | 0.07 to 0.08 | Not bendable without breaking | Type 1 |
| PC7E8S1A16 | 10.5 | 0.07 to 0.08 | Not bendable without breaking | Type 1 |
| PC7E8S8A1 | 10.5 | 0.07 to 0.08 | Not bendable without breaking | Type 1 |
| PC7E8S8A2 | 10.5 | 0.07 to 0.08 | Bendable on one side with wheel side out | Type 2 |
| PC7E8S8A3 | 10.5 | 0.07 to 0.08 | Bendable on one side with wheel side out | Type 2 |
| PC7E8S8A4 | 10.5 | 0.07 to 0.08 | Bendable on one side with wheel side out | Type 2 |

TABLE 10-continued

| Ribbon Thickness, Bending Response and Behavior Type | | | | |
|---|---|---|---|---|
| Alloy | Wheel Speed (m/s) | Ribbon Thickness (mm) | Bending Response | Behavior Type |
| PC7E8S8A5 | 10.5 | 0.07 to 0.08 | Bendable on both sides | Type 4 |
| PC7E8S8A6 | 10.5 | 0.07 to 0.08 | Bendable on both sides | Type 4 |
| PC7E8S8A7 | 10.5 | 0.07 to 0.08 | Bendable on both sides | Type 4 |
| PC7E8S8A8 | 10.5 | 0.07 to 0.08 | Bendable on one side with wheel side out | Type 2 |

TABLE 11

| Summary of Tensile Test Results at 10.5 m/s (uncorrected) | | | | |
|---|---|---|---|---|
| | Total Elongation (%) | Yield Strength (GPa) | UTS (GPA) | Young's Modulus (GPa) |
| PC7E8S1A1 | 7.41 | 1.25 | 1.45 | 23.30 |
| | 9.05 | 1.44 | 1.68 | 25.40 |
| | 7.38 | 1.27 | 1.42 | 22.60 |
| PC7E8S1A2 | 6.48 | 1.38 | 1.41 | 23.10 |
| | 6.40 | 1.43 | 1.48 | 29.40 |
| | 6.61 | 1.73 | 1.79 | 28.10 |
| PC7E8S1A3 | 7.29 | 1.57 | 1.98 | 29.50 |
| | 7.50 | 1.48 | 1.75 | 25.60 |
| | 4.27 | 1.37 | 1.38 | 27.50 |
| PC7E8S1A4 | 5.02 | 1.21 | 1.23 | 27.20 |
| | 9.87 | 1.36 | 1.38 | 15.40 |
| | 6.67 | 1.17 | 1.19 | 19.10 |
| PC7E8S1A5 | 8.16 | 1.61 | 2.01 | 24.20 |
| | 10.00 | 1.59 | 2.38 | 25.00 |
| | 8.33 | 1.43 | 1.94 | 24.90 |
| PC7E8S1A6 | 6.07 | 1.36 | 1.57 | 27.00 |
| | 5.96 | 1.46 | 1.50 | 22.50 |
| | 10.94 | 1.77 | 2.76 | 25.30 |
| PC7E8S1A7 | 14.89 | 1.46 | 2.70 | 18.90 |
| | 15.10 | 1.56 | 2.70 | 27.10 |
| | 14.06 | 1.67 | 2.76 | 22.90 |
| PC8E8S1A8 | 9.83 | 1.52 | 2.09 | 22.50 |
| | 15.22 | 1.72 | 3.15 | 22.00 |
| | 14.96 | 1.26 | 3.08 | 25.20 |
| PC7E8S1A9 | 13.03 | 1.33 | 2.57 | 25.60 |
| | 13.73 | 1.36 | 2.61 | 26.80 |
| | 15.38 | 1.00 | 2.58 | 25.50 |
| PC7E8S1A10 | 15.26 | 1.42 | 2.92 | 23.00 |
| | 12.93 | 1.58 | 2.87 | 26.50 |
| | 12.50 | 1.52 | 3.02 | 29.70 |
| PC7E8S1A11 | 4.27 | 1.06 | 1.09 | 25.20 |
| | 6.90 | 1.17 | 1.41 | 22.40 |
| | 5.37 | 1.34 | 1.34 | 24.60 |
| PC7E8S1A12 | 1.63 | 0.36 | 0.36 | 26.20 |
| | 1.68 | 0.43 | 0.53 | 20.30 |
| | 1.76 | 0.58 | 0.58 | 19.50 |
| PC7E8S1A13 | 11.06 | 1.58 | 2.59 | 26.70 |
| | 14.11 | 1.30 | 2.60 | 23.80 |
| | 11.76 | 1.36 | 2.42 | 23.70 |
| PC7E8S1A14 | 12.35 | 1.33 | 2.40 | 23.80 |
| | 8.44 | 1.25 | 1.91 | 25.20 |
| | 14.16 | 1.38 | 2.31 | 18.30 |
| PC7E8S1A15 | 5.42 | 1.26 | 1.26 | 23.70 |
| | 6.49 | 1.14 | 1.39 | 23.50 |
| | 5.19 | 1.33 | 1.36 | 29.20 |
| PC7E8S8A1 | 14.22 | 1.35 | 2.47 | 23.20 |
| | 9.83 | 1.18 | 2.11 | 25.90 |
| | 14.29 | 1.11 | 2.15 | 18.90 |
| PC7E8S8A2 | 11.20 | 1.34 | 2.35 | 23.50 |
| | 14.41 | 1.23 | 2.83 | 24.90 |
| | 11.89 | 1.54 | 2.52 | 22.46 |
| PC7E8S8A3 | 7.83 | 1.52 | 1.80 | 23.70 |
| | 10.92 | 1.50 | 2.21 | 20.60 |
| | 6.82 | 1.51 | 1.81 | 23.50 |
| PC7E8S8A4 | 6.78 | 1.18 | 1.37 | 21.60 |
| | 6.78 | 1.28 | 1.51 | 23.50 |
| | 6.53 | 1.08 | 1.37 | 20.70 |

TABLE 11-continued

| Summary of Tensile Test Results at 10.5 m/s (uncorrected) | | | | |
|---|---|---|---|---|
| | Total Elongation (%) | Yield Strength (GPa) | UTS (GPA) | Young's Modulus (GPa) |
| PC7E8S8A5 | 13.67 | 1.30 | 2.58 | 24.40 |
| | 17.65 | 1.48 | 2.47 | 21.90 |
| | 15.02 | 1.38 | 2.63 | 21.30 |
| PC7E8S8A6 | 14.98 | 1.54 | 2.93 | 23.30 |
| | 14.64 | 1.71 | 2.82 | 24.60 |
| | 14.89 | 1.50 | 2.67 | 15.10 |
| PC7E8S8A7 | 8.71 | 1.63 | 2.09 | 31.30 |
| | 12.64 | 1.76 | 2.98 | 25.80 |
| | 11.26 | 1.71 | 2.75 | 27.00 |
| PC7E8S8A8 | 16.38 | 1.04 | 2.69 | 24.80 |
| | 13.04 | 1.30 | 2.34 | 21.90 |
| | 11.97 | 1.00 | 2.12 | 21.70 |

For the tensile measurements shown in Table 11, the data can be corrected to adjust for machine compliance coefficient and deviations in cross sectional area from rectangular cross sections. The corrected data which represents the most accurate tensile results are shown in Table 12. As can be seen the tensile strength values are high and vary from 0.40 to 3.47 GPa while the total elongation values are very significant for reduced length scale microstructures and vary from 0.65 to 7.06%.

TABLE 12

| Summary of Tensile Test Results at 10.5 m/s (corrected) | | | | |
|---|---|---|---|---|
| | Total Elongation (%) | Yield Strength (GPa) | UTS (GPA) | Young's Modulus (GPa) |
| PC7E8S1A1 | 2.96 | 1.38 | 1.60 | 88.54 |
| | 3.62 | 1.58 | 1.85 | 96.52 |
| | 2.95 | 1.40 | 1.56 | 85.88 |
| PC7E8S1A2 | 2.59 | 1.52 | 1.55 | 87.78 |
| | 2.56 | 1.57 | 1.63 | 111.72 |
| | 2.64 | 1.90 | 1.97 | 106.78 |
| PC7E8S1A3 | 2.92 | 1.73 | 2.18 | 112.10 |
| | 3.00 | 1.63 | 1.93 | 97.28 |
| | 1.71 | 1.51 | 1.52 | 104.50 |
| PC7E8S1A4 | 2.01 | 1.33 | 1.35 | 103.36 |
| | 3.95 | 1.50 | 1.52 | 58.52 |
| | 2.67 | 1.29 | 1.31 | 72.58 |
| PC7E8S1A5 | 3.26 | 1.77 | 2.21 | 91.96 |
| | 4.00 | 1.75 | 2.62 | 95.00 |
| | 3.33 | 1.57 | 2.13 | 94.62 |
| PC7E8S1A6 | 2.43 | 1.50 | 1.73 | 102.60 |
| | 2.38 | 1.61 | 1.65 | 85.50 |
| | 4.38 | 1.95 | 3.04 | 96.14 |
| PC7E8S1A7 | 5.96 | 1.61 | 2.97 | 71.82 |
| | 6.04 | 1.72 | 2.97 | 102.98 |
| | 5.62 | 1.84 | 3.04 | 87.02 |
| PC8E8S1A8 | 3.93 | 1.67 | 2.30 | 85.50 |
| | 6.09 | 1.89 | 3.47 | 83.60 |
| | 5.98 | 1.39 | 3.39 | 95.76 |

TABLE 12-continued

Summary of Tensile Test Results at 10.5 m/s (corrected)

| | Total Elongation (%) | Yield Strength (GPa) | UTS (GPA) | Young's Modulus (GPa) |
|---|---|---|---|---|
| PC7E8S1A9 | 5.21 | 1.46 | 2.83 | 97.28 |
| | 5.49 | 1.50 | 2.87 | 101.84 |
| | 6.15 | 1.10 | 2.84 | 96.90 |
| PC7E8S1A10 | 6.10 | 1.56 | 3.21 | 87.40 |
| | 5.17 | 1.74 | 3.16 | 100.70 |
| | 5.00 | 1.67 | 3.32 | 112.86 |
| PC7E8S1A11 | 1.71 | 1.17 | 1.20 | 95.76 |
| | 2.76 | 1.29 | 1.55 | 85.12 |
| | 2.15 | 1.47 | 1.47 | 93.48 |
| PC7E8S1A12 | 0.65 | 0.40 | 0.40 | 99.56 |
| | 0.67 | 0.47 | 0.58 | 77.14 |
| | 0.70 | 0.64 | 0.64 | 74.10 |
| PC7E8S1A13 | 4.42 | 1.74 | 2.85 | 101.46 |
| | 5.64 | 1.43 | 2.86 | 90.44 |
| | 4.70 | 1.50 | 2.66 | 90.06 |
| PC7E8S1A14 | 4.94 | 1.46 | 2.64 | 90.44 |
| | 3.38 | 1.38 | 2.10 | 95.76 |
| | 5.66 | 1.52 | 2.54 | 69.54 |
| PC7E8S1A15 | 2.17 | 1.39 | 1.39 | 90.06 |
| | 2.60 | 1.25 | 1.53 | 89.30 |
| | 2.08 | 1.46 | 1.50 | 110.96 |
| PC7E8S8A1 | 5.69 | 1.49 | 2.72 | 88.16 |
| | 3.93 | 1.30 | 2.32 | 98.42 |
| | 5.72 | 1.22 | 2.37 | 71.82 |
| PC7E8S8A2 | 4.48 | 1.47 | 2.59 | 89.30 |
| | 5.76 | 1.35 | 3.11 | 94.62 |
| | 4.76 | 1.69 | 2.77 | 85.35 |
| PC7E8S8A3 | 3.13 | 1.67 | 1.98 | 90.06 |
| | 4.37 | 1.65 | 2.43 | 78.28 |
| | 2.73 | 1.66 | 1.99 | 89.30 |
| PC7E8S8A4 | 2.71 | 1.30 | 1.51 | 82.08 |
| | 2.71 | 1.41 | 1.66 | 89.30 |
| | 2.61 | 1.19 | 1.51 | 78.66 |
| PC7E8S8A5 | 5.47 | 1.43 | 2.84 | 92.72 |
| | 7.06 | 1.63 | 2.72 | 83.22 |
| | 6.01 | 1.52 | 2.89 | 80.94 |
| PC7E8S8A6 | 5.99 | 1.69 | 3.22 | 88.54 |
| | 5.86 | 1.88 | 3.10 | 93.48 |
| | 5.96 | 1.65 | 2.94 | 57.38 |
| PC7E8S8A7 | 3.48 | 1.79 | 2.30 | 118.94 |
| | 5.06 | 1.94 | 3.28 | 98.04 |
| | 4.50 | 1.88 | 3.03 | 102.60 |
| PC7E8S8A8 | 6.55 | 1.14 | 2.96 | 94.24 |
| | 5.22 | 1.43 | 2.57 | 83.22 |
| | 4.79 | 1.10 | 2.33 | 82.46 |

Case Example 6

Using commercial purity feedstock including ferroadditives, 15 g alloy feedstocks of the targeted alloys were weighed out according to the atomic ratio's provided in Table 13. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. For each ingot, the density was measured using the Archimedes principle and the results are shown in Table 14. As shown, the densities were found to vary from 7.28 to 7.81 g/cm$^3$. The resulting arc-melted ingots were then placed in a melt-spinning chamber in a quartz crucible with a hole diameter of ~0.81 mm. The ingots were melted in a air using RF induction and then ejected with a melt superheat of 150° C. and a chamber pressure of 280 mbar onto a 245 mm diameter copper wheel which was traveling at tangential velocities of 25 m/s. Long ribbon lengths typically from 0.7 to 1.5 mm in width were obtained. The thickness of the ribbons produced was then measured in a micrometer and the results are tabulated in Table 14. As shown, the thickness was dependant on alloy chemistry and was found to vary from 37 to 55 μm. Bending testing (180°) of the as-spun ribbon samples were done on each sample and the results were correlated in Table 9. As shown, depending on the alloy when processed on the particular conditions listed, the bending response was found to vary but the primary response was Type 4 Behavior (i.e. bendable on both sides).

TABLE 13

Chemical Composition of Alloys

| Alloy | Fe | Ni | Co | B | Si | Cr | C |
|---|---|---|---|---|---|---|---|
| A01F03 | 60.83 | 15.44 | 2.81 | 14.03 | 4.00 | 2.89 | — |
| A01B03 | 60.22 | 15.29 | 2.78 | 13.89 | 3.96 | 2.86 | 1.00 |
| A01B04 | 59.61 | 15.13 | 2.75 | 13.75 | 3.92 | 2.83 | 2.00 |
| C01F03 | 58.30 | 14.80 | 2.69 | 13.45 | 8.00 | 2.77 | — |
| C01B03 | 57.76 | 14.67 | 2.67 | 13.32 | 7.84 | 2.74 | 1.00 |
| C01B04 | 57.18 | 14.52 | 2.64 | 13.19 | 7.76 | 2.71 | 2.00 |
| C01B05 | 56.54 | 14.36 | 2.61 | 13.05 | 7.76 | 2.69 | 3.00 |
| C01B06 | 55.96 | 14.21 | 2.58 | 12.91 | 7.68 | 1.66 | 4.00 |
| D01F03 | 55.96 | 14.21 | 2.58 | 12.91 | 11.68 | 2.66 | — |
| D01B03 | 55.38 | 14.06 | 2.56 | 12.78 | 11.60 | 2.63 | 1.00 |
| E01F03 | 53.63 | 13.62 | 2.47 | 12.37 | 15.36 | 2.55 | — |
| F01F03 | 59.62 | 15.13 | 2.75 | 13.75 | 5.91 | 2.84 | — |

TABLE 14

Melt-Spinning of Alloys at MS45 Parameter

| Alloy | Density [g/cm$^3$] | Thickness [μm] | Bend Ability Type |
|---|---|---|---|
| A01F03 | 7.72 | 37-42 | 4 |
| A01B03 | 7.81 | 42-47 | 4 |
| A01B04 | 7.62 | 41-55 | 4 |
| C01F03 | 7.56 | 47-49 | 4 |
| C01B03 | 7.48 | 44-52 | 4 |
| C01B04 | 7.48 | 45-47 | 4 |
| C01B05 | 7.48 | 51-55 | 4 |
| C01B06 | 7.44 | 46-48 | 4 |
| D01F03 | 7.40 | 44-48 | 4 |
| D01B03 | 7.38 | 42-57 | 4/1 |
| E01F03 | 7.28 | 43-50 | 1 |
| F01F03 | 7.60 | 41-47 | 4 |

Thermal analysis was done on the as-solidified ribbons of Table 13 using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 15, the DSC data related to the glass to crystalline transformation is shown for the alloys that have been melt-spun in air at 25 m/s. All of the samples were found to contain a significant fraction of glass. The glass to crystalline transformation occurs in either one stage or two stages in the range of temperature from 452 to 595° C. and with enthalpies of transformation from −22.8 to 115.8 J/g.

TABLE 15

DTA Data

| Alloy | Glass Present | Peak #1 Onset [° C.] | Peak #1 Temp [° C.] | Peak #1 - ΔH [J/g] | Peak #2 Onset [° C.] | Peak #2 Temp [° C.] | Peak #2 - ΔH [J/g] |
|---|---|---|---|---|---|---|---|
| A01F03 | Y | 452 | 463 | 52.5 | 501 | 509 | 77.3 |
| A01B03 | Y | 455 | 467 | 55.6 | 502 | 512 | 78.4 |
| A01B04 | Y | 469 | 483 | 62.0 | 502 | 518 | 51.9 |
| C01F03 | Y | 510 | 524 | 105.4 | — | — | — |
| C01B03 | Y | 520 | 531 | 115.8 | — | — | — |

TABLE 15-continued

| DTA Data | | | | | | | |
|---|---|---|---|---|---|---|---|
| Alloy | Glass Present | Peak #1 Onset [° C.] | Peak #1 Temp [° C.] | Peak #1 - ΔH [J/g] | Peak #2 Onset [° C.] | Peak #2 Temp [° C.] | Peak #2 - ΔH [J/g] |
| C01B04 | Y | 526 | 536 | 103.9 | — | — | — |
| C01B05 | Y | 529 | 539 | 109.5 | | | |
| C01B06 | Y | 537 | 545 | 98.2 | | | |
| D01F03 | Y | 540 | 546 | 108.0 | — | 578* | — |
| D01B03 | Y | 547 | 554 | 110.8 | — | — | — |
| E01F03 | Y | 553 | 558 | 108.0 | 585 | 595 | 22.8 |
| F01F03 | Y | 504 | 519 | 111.1 | — | — | — |

*Overlapping peak

In Table 16, a summary of the tensile test results including gage dimensions, elongation, yield breaking load, strength and Young's Modulus are shown for each alloy of Table 13. Note that each distinct sample was measured in triplicate since occasional macrodefects arising from the melt-spinning process can lead to localized stresses reducing properties. As can be seen the total elongation values are significant and vary from 1.97 to 4.78% with high tensile strength values from to GPa. Young's Modulus was found to vary from 1.12 to 2.92 GPa. Note that the results shown in Table 16 have been adjusted for machine compliance and geometric cross sectional area.

Case Example 7

Using commercial purity feedstock including ferroadditives, 15 g alloy feedstocks of the C01F03 and C01B03 alloys were weighed out according to the atomic ratio's provided in Table 13. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. To show variability in properties, the alloys were process into ribbons using different parameters as shown in Table 17. Note that the C01F03 alloy was processed using the MS45 and MS58 parameter while the C01B03 alloy was processed using the MS45, MS50, and MS55 parameter. Thermal analysis was done on the as-solidified ribbons of Table 13 using a Perkin Elmer DTA-7 system with the DSC-7 option at a heating rate of 10° C./minute with samples protected from oxidation through the use of flowing ultrahigh purity argon. In Table 19, the results of the DSC analysis is shown. As indicated, the onset temperatures, peak temperatures, and enthalpies can vary with process parameter.

TABLE 16

| Tensile Property of Fibers | | | | | | | | | | |
|---|---|---|---|---|---|---|---|---|---|---|
| | Gage Dimensions (mm) | | | Elongation (%) | | | Break Load | Strength (GPa) | | Young's Modulus |
| Alloy | w | T | l | Tot | Elastic | Plastic | (N) | Yield | UTS | (GPa) |
| A01F03 | 1.36 | 0.040 | 9.00 | 2.67 | 1.56 | 1.11 | 130.5 | 1.59 | 2.55 | 87.2 |
| | 1.37 | 0.038 | 9.00 | 2.89 | 1.16 | 2.21 | 142.8 | 1.42 | 2.92 | 94.8 |
| | 1.38 | 0.040 | 9.00 | 3.11 | 1.25 | 2.33 | 144.8 | 2.11 | 2.79 | 95.6 |
| A01B03 | 1.39 | 0.044 | 9.00 | 2.89 | 1.56 | 1.33 | 140.0 | 1.38 | 2.44 | 80.0 |
| | 1.32 | 0.040 | 9.00 | 2.56 | 1.44 | 1.11 | 128.5 | 1.62 | 2.59 | 93.9 |
| | 1.30 | 0.041 | 9.00 | 2.22 | 1.56 | 0.67 | 110.1 | 2.10 | 2.20 | 91.0 |
| A01B04 | 1.40 | 0.041 | 9.00 | 2.67 | 1.33 | 1.33 | 143.1 | 1.39 | 2.66 | 91.9 |
| | 1.47 | 0.042 | 9.00 | 3.04 | 1.73 | 1.31 | 135.7 | 1.34 | 2.20 | 88.3 |
| | 1.36 | 0.041 | 9.00 | 2.56 | 1.67 | 0.89 | 130.7 | 1.37 | 2.50 | 91.5 |
| C01F03 | 1.40 | 0.046 | 9.00 | 3.56 | 1.33 | 2.22 | 153.1 | 1.13 | 2.35 | 83.1 |
| | 1.40 | 0.046 | 9.00 | 2.78 | 1.33 | 1.44 | 142.1 | 1.58 | 2.38 | 87.3 |
| | 1.44 | 0.048 | 9.00 | 3.54 | 1.42 | 2.12 | 148.8 | 1.18 | 2.15 | 88.5 |
| C01B03 | 1.31 | 0.042 | 9.00 | 2.67 | 1.22 | 1.44 | 141.4 | 1.31 | 2.75 | 107.1 |
| | 1.25 | 0.042 | 9.00 | 2.67 | 1.33 | 1.33 | 137.3 | 1.72 | 2.80 | 105.6 |
| | 1.26 | 0.041 | 9.00 | 3.78 | 1.78 | 2.00 | 140.5 | 1.55 | 2.91 | 82.2 |
| C01B04 | 1.34 | 0.042 | 9.00 | 4.33 | 1.44 | 2.89 | 150.8 | 1.13 | 2.87 | 73.2 |
| | 1.36 | 0.043 | 9.00 | 3.56 | 1.33 | 2.22 | 156.6 | 1.27 | 2.86 | 94.2 |
| | 1.34 | 0.044 | 9.00 | 4.78 | 1.33 | 3.44 | 156.1 | 0.88 | 2.83 | 79.7 |
| C01B05 | 1.43 | 0.047 | 9.00 | 2.78 | 1.33 | 1.44 | 147.1 | 1.43 | 2.32 | 89.0 |
| | 1.47 | 0.047 | 9.00 | 3.89 | 1.56 | 2.33 | 148.2 | 1.12 | 2.27 | 68.4 |
| | 1.47 | 0.045 | 9.00 | 4.44 | 1.33 | 3.11 | 164.6 | 1.06 | 2.64 | 80.5 |
| C01B06 | 1.31 | 0.046 | 9.00 | 3.11 | 1.33 | 1.78 | 150.0 | 1.40 | 2.66 | 96.5 |
| | 1.36 | 0.045 | 9.00 | 3.22 | 1.33 | 1.89 | 144.3 | 1.07 | 2.52 | 92.1 |
| | 1.36 | 0.045 | 9.00 | 3.78 | 1.33 | 2.44 | 155.8 | 1.11 | 2.72 | 84.9 |
| D01F03 | 1.24 | 0.045 | 9.00 | 3.67 | 1.67 | 2.00 | 136.6 | 1.54 | 2.52 | 72.7 |
| | 1.24 | 0.044 | 9.00 | 2.67 | 1.33 | 1.33 | 128.3 | 1.92 | 2.25 | 96.6 |
| | 1.25 | 0.045 | 9.00 | 2.67 | 1.56 | 1.11 | 118.5 | 1.22 | 2.30 | 85.0 |
| D01B03 | 1.27 | 0.040 | 9.00 | 3.22 | 1.56 | 1.67 | 109.3 | 1.18 | 2.45 | 78.0 |
| | 1.24 | 0.043 | 9.00 | 3.78 | 1.56 | 2.22 | 122.3 | 1.32 | 2.25 | 66.3 |
| | 1.28 | 0.041 | 9.00 | 2.89 | 1.33 | 1.56 | 110.6 | 1.09 | 2.09 | 81.1 |
| E01F03 | 1.25 | 0.043 | 9.00 | 2.44 | 1.33 | 1.11 | 104.8 | 1.32 | 1.50 | 85.3 |
| | 1.24 | 0.038 | 9.00 | 3.15 | 1.24 | 1.91 | 98.6 | 0.92 | 1.42 | 71.7 |
| | 1.33 | 0.039 | 9.00 | 1.97 | 1.63 | 0.34 | 58.2 | 1.08 | 1.12 | 76.6 |
| F01F03 | 1.31 | 0.040 | 9.00 | 2.33 | 1.33 | 1.00 | 103.1 | 1.18 | 2.44 | 85.4 |
| | 1.24 | 0.042 | 9.00 | 3.67 | 1.33 | 2.33 | 118.6 | 1.38 | 2.56 | 78.9 |
| | 1.28 | 0.040 | 9.00 | 3.33 | 1.44 | 1.89 | 122.5 | 1.17 | 2.73 | 85.4 |

TABLE 17

| Process Parameter List | | | | | | | |
|---|---|---|---|---|---|---|---|
| MS | Chamber gas | Pressure in chamber [mbar] | Pressure in ballast [torr] | Wheel Speed [m/s] | Crucible-chill gap [mm] | Ejection Pressure [mbar] | Superheat* [° C.] |
| 45 | Air | 340 | 465.0 | 25 | 5 | 280 | 150 |
| 50 | $CO_2$ | 340 | 360. | 25 | 5 | 280 | 50 |
| 55 | Air | 1036 | 987.2 | 25 | 5 | 280 | 50 |
| 58 | Air | 340 | 465.0 | 39 | 5 | 28 | 100 |

Note
degrees above liquidus temperature

TABLE 18

| Alloys Processed At Different Parameters | | | | |
|---|---|---|---|---|
| Alloy | Process Parameter | Density [g/cm$^3$] | Thickness [μm] | Bend Ability Type |
| C01F03 | MS45 | 7.56 | 47-49 | 4 |
| C01F03 | MS58 | 7.56 | 30-32 | 4 |
| C01B03 | MS45 | 7.48 | 44-52 | 4 |
| C01B03 | MS50 | 7.50 | 40-44 | 4 |
| C01B03 | MS55 | 7.49 | 50-62 | 1 |

TABLE 19

| DTA Data Summary | | | | | |
|---|---|---|---|---|---|
| Alloy | Process | Glass Present | Peak #1 Onset [° C.] | Peak #1 Temp [° C.] | Peak #1 - ΔH [J/g] |
| C01F03 | MS45 | Y | 510.1 | 524.4 | 105.4 |
| C01F03 | MS58 | Y | 508.5 | 523.7 | 107.6 |
| C01B03 | MS45 | Y | 520.3 | 531.0 | 115.8 |

TABLE 19-continued

| DTA Data Summary | | | | | |
|---|---|---|---|---|---|
| Alloy | Process | Glass Present | Peak #1 Onset [° C.] | Peak #1 Temp [° C.] | Peak #1 - ΔH [J/g] |
| C01B03 | MS50 | Y | 521.2 | 532.0 | 105.1 |
| C01B03 | MS55 | Y | 519.8 | 532.4 | 113.9 |

In Table 20, a summary of the tensile test results including gage dimensions, elongation, yield breaking load, strength and Young's Modulus are shown for each alloy of Table 13. Note that each distinct sample was measured in triplicate since occasional macrodefects arising from the melt-spinning process can lead to localized stresses reducing properties. As can be seen the tensile properties can vary dramatically as a function of processing parameter. Note that the results shown in Table 16 have been adjusted for machine compliance and geometric cross sectional area.

TABLE 20

| Tensile Property Summary | | | | | | | | | | |
|---|---|---|---|---|---|---|---|---|---|---|
| Alloy/ Process | Gage Dimensions (mm) | | | Elongation (%) | | | Break Load | Strength (GPa) | | Modulus |
| Parameter | w | T | l | Tot | Elastic | Plastic | (N) | Yield | UTS | (GPa) |
| C01F03 | 1.40 | 0.046 | 9.00 | 3.56 | 1.33 | 2.22 | 153.1 | 1.13 | 2.35 | 83.1 |
| MS45 | 1.40 | 0.046 | 9.00 | 2.78 | 1.33 | 1.44 | 142.1 | 1.58 | 2.38 | 87.3 |
| | 1.44 | 0.048 | 9.00 | 3.54 | 1.42 | 2.12 | 148.8 | 1.18 | 2.15 | 88.5 |
| C01F03 | 1.10 | 0.030 | 9.00 | 2.00 | 1.33 | 0.67 | 65.60 | 1.42 | 2.13 | 98.4 |
| MS58 | 1.15 | 0.029 | 9.00 | 1.67 | 1.33 | 0.33 | 50.00 | 1.13 | 1.60 | 101.9 |
| | 1.21 | 0.031 | 9.00 | 1.78 | 1.33 | 0.44 | 57.17 | 1.22 | 2.53 | 91.1 |
| C01B03 | 1.31 | 0.042 | 9.00 | 2.67 | 1.22 | 1.44 | 141.4 | 1.31 | 2.75 | 107.1 |
| MS45 | 1.25 | 0.042 | 9.00 | 2.67 | 1.33 | 1.33 | 137.3 | 1.72 | 2.80 | 105.6 |
| | 1.26 | 0.041 | 9.00 | 3.78 | 1.78 | 2.00 | 140.5 | 1.55 | 2.91 | 82.2 |
| C01B03 | 1.53 | 0.038 | 9.00 | 4.22 | 1.33 | 2.89 | 158.7 | 1.16 | 2.88 | 85.2 |
| MS50 | 1.53 | 0.038 | 9.00 | 4.44 | 1.33 | 3.11 | 168.3 | 1.22 | 3.05 | 78.5 |
| | 1.52 | 0.039 | 9.00 | 4.00 | 1.33 | 2.67 | 164.0 | 1.06 | 2.92 | 121.8 |
| C01B03 MS55 | Too brittle to test | | | | | | | | | |

The results of this case example, clearly show some of the variability with respect to physical property changes of the alloys with respect to process parameters. In an illustrated case for example, the C01B03 alloy went from a ductile sample when processed at the MS50 parameter to a brittle sample when processed using the MS55 parameter. This change is consistent with the proposed mechanism which shows that only with specific structures does a ductile sample result. It is believed that a much broader range in properties could be obtained with the identified alloys by optimizing process parameters further. Additionally, this shows that additionally chemistry variations are possible by commensurately changing process parameters. Note that this change in structure and properties through processing alterations is a well established basis in modern metallurgy.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of forming spinodal microconstituents in an alloy comprising:

melting alloy constituents including 52 atomic percent to 60 atomic percent iron, 15.5 to 21 atomic percent nickel, 6.3 to 11.6 atomic percent cobalt, 10.3 to 13.2 atomic percent boron, 3.7 to 4.8 atomic percent carbon, and 0.3 to 0.5 atomic percent silicon to form an alloy;

cooling said alloy; and forming one or more spinodal microconstituents in a glass matrix through spinodal decomposition wherein said alloy separates into distinct regions with different chemical compositions and physical properties and is not nucleation controlled, wherein said spinodal microconstituents are present in the range of 5% to 95% by volume and said spinodal microconstituents exhibit a length scale less than 50 nm in a glass matrix.

2. A method of forming spinodal microconstituents in an alloy comprising:

melting alloy constituents including 58.4 atomic percent to 67.6 atomic percent iron, 16.0 to 16.6 atomic percent nickel, 2.9 to 3.1 atomic percent cobalt, 12.0 to 18.5 atomic percent boron, optionally 1.5 to 4.6 atomic percent carbon and optionally 0.4 to 3.5 atomic percent silicon, to form an alloys cooling said alloy; and forming one or more spinodal microconstituents in a glass matrix through spinodal decomposition wherein said alloy separates into distinct regions with different chemical compositions and physical properties and is not nucleation controlled, wherein said spinodal microconstituents are present in the range of 5% to 95% by volume and said spinodal microconstituents exhibit a length scale less than 50 nm in a glass matrix.

3. A method of forming spinodal microconstituents in an alloy comprising:

melting alloy constituents including 53.6 atomic percent to 60.9 atomic percent iron, 13.6 to 15.5 atomic percent nickel, 2.4 to 2.9 atomic percent cobalt, 12 to 14.1 atomic percent boron, 1 to 4 atomic percent carbon 3.9 to 15.4 atomic percent silicon, and 1.6 to 2.9 atomic percent chromium, to form an alloy;

cooling said alloy; and forming one or more spinodal microconstituents in a glass matrix through spinodal decomposition wherein said alloy separates into distinct regions with different chemical compositions and physical properties and is not nucleation controlled, wherein said spinodal microconstituents are present in the range of 5% to 95% by volume and said spinodal microconstituents exhibit a length scale less than 50 nm in a glass matrix.

4. The method of claim 1, wherein said alloy is cooled at a rate at or greater than the critical cooling rate of the alloy.

5. The method of claim 1, wherein said alloy is cooled by melt spinning.

6. The method of claim 1, wherein said alloy is formed into a ribbon.

7. The method of claim 1, wherein said alloy is formed into a product having a thickness from 1 μm to 2000 μm.

8. The method of claim 2, wherein said alloy is cooled at a rate at or greater than the critical cooling rate of the alloy.

9. The method of claim 2, wherein said alloy is cooled by melt spinning.

10. The method of claim 2, wherein said alloy is formed into a ribbon.

11. The method of claim 2, wherein said alloy is formed into a product having a thickness from 1 μm to 2000 μm.

12. The method of claim 3, wherein said alloy is cooled at a rate at or greater than the critical cooling rate of the alloy.

13. The method of claim 3, wherein said alloy is cooled by melt spinning.

14. The method of claim 3, wherein said alloy is formed into a ribbon.

15. The method of claim 3, wherein said alloy is formed into a product having a thickness from 1 μm to 2000 μm.

* * * * *

UNITED STATES PATENT AND TRADEMARK OFFICE

CERTIFICATE OF CORRECTION

PATENT NO. : 8,882,941 B2
APPLICATION NO. : 12/580858
DATED : November 11, 2014
INVENTOR(S) : Daniel James Branagan et al.

It is certified that error appears in the above-identified patent and that said Letters Patent is hereby corrected as shown below:

On the title page, item (54), and in the Specification, in column 1, line 1-4, in "Title", delete "MECHANISM OF STRUCTURAL FORMATION FOR METALLIC GLASS BASED COMPOSITES WITH ENHANCED DUCTILITY" and insert -- MECHANISM OF STRUCTURAL FORMATION FOR METALLIC GLASS BASED COMPOSITES EXHIBITING DUCTILITY --, therefor.

On the title page, item (74), in column 2, in "Attorney, Agent, or Firm", line 1, delete "Perrault" and insert -- Perreault" --, therefor.

On title page 2, item (56), in column 2, under "Other Publications", line 40, delete "Alll" and insert -- All --, therefor.

On title page 2, item (56), in column 2, under "Other Publications", line 60, delete "strenght" and insert -- strength --, therefor.

In the Claims

In column 30, line 8, in claim 3, delete "carbon" and insert -- carbon, --, therefor.

Signed and Sealed this
Seventh Day of April, 2015

Michelle K. Lee

Michelle K. Lee
*Director of the United States Patent and Trademark Office*